US006634572B1

(12) United States Patent
Burgener

(10) Patent No.: US 6,634,572 B1
(45) Date of Patent: Oct. 21, 2003

(54) ENHANCED PARALLEL PATH NEBULIZER WITH A LARGE RANGE OF FLOW RATES

(76) Inventor: John A. Burgener, 944 Meadow Wood Road, Mississauga (CA), L5J 2S6

( * ) Notice: Subject to any disclaimer, the term of this patent is extended or adjusted under 35 U.S.C. 154(b) by 0 days.

(21) Appl. No.: 10/161,314

(22) Filed: May 31, 2002

(51) Int. Cl.[7] ..... F23D 14/62

(52) U.S. Cl. ..... 239/418; 239/423

(58) Field of Search ..... 239/1, 8, 418, 239/423, 424

(56) References Cited

U.S. PATENT DOCUMENTS 3,980,233 A * 9/1976 Simmons et al. ..... 239/400
5,411,208 A * 5/1995 Burgener ..... 239/8
6,166,379 A * 12/2000 Montaser et al. ..... 250/288

OTHER PUBLICATIONS

A. Bestok et al. "Models and Scaling Laws for Rarefied Internal Gas Flows Including Separation" 11 pages, Nov. 19–21, 1995.

* cited by examiner

*Primary Examiner*—Brian L. Casler
*Assistant Examiner*—Lina R Kontos
(74) *Attorney, Agent, or Firm*—Weingarten, Schurgin, Gagnebin & Lebovici LLP

(57) ABSTRACT

A system and process for atomizing liquids at an interface between the liquid and an ambient gas or air is provided. The system includes the steps of providing a gas stream in close proximity to the liquid, having a gas orifice shaped so that the liquid is induced to extend past the slower moving gas at the outer edge of the gas stream to a faster, more central portion of the gas stream, being broken up into aerosol particles, and atomizing the liquid into a gaseous medium as a fine, highly consistent and uniform dispersion. This system and method can significantly improve the aerosol and increase the range of liquid flow rates over which the nebulizer operate.

18 Claims, 6 Drawing Sheets

ENHANCED PARALLEL PATH NEBULIZER WITH A LARGE RANGE OF FLOW RATES

CROSS REFERENCE TO RELATED APPLICATIONS

N/A.

STATEMENT REGARDING FEDERALLY SPONSORED RESEARCH OR DEVELOPMENT

N/A.

BACKGROUND OF THE INVENTION

Many methods and apparatus are known for atomizing liquids. Parallel path nebulizers have been used extensively for Inductively Coupled Plasma Spectrometer (ICP) sample introduction. A known parallel path nebulizer is disclosed in U.S. Pat. No. 5,411,208 to Burgener. This nebulizing process and device independently brings the gas and liquid flow together with a gas orifice on or near the edge of the liquid path with the gas orifice being much smaller than the area of the liquid path.

A cross section of this nebulizer is illustrated in FIG. 1 where liquid is supplied through a constrained liquid passage A and gas is supplied to a gas supply passage D. A liquid exit area C and a gas orifice F are positioned so that the liquid is delivered close enough to be drawn into the gas stream. The nebulizer atomizes liquids directly from the surface of a body of liquid, using induction and the surface tension of a liquid to draw the liquid into the gas stream.

FIGS. 2A, 2B, and 2C illustrate liquid exit areas and gas orifice configurations for conventional parallel path nebulizers. FIG. 2A illustrates a gas orifice $F_1$ positioned inside of the liquid passage $C_1$. FIG. 2B illustrates a gas orifice $F_2$ positioned on the edge of the liquid passage $C_2$. FIG. 2C illustrates a gas orifice $F_3$ that is positioned just outside of the liquid passage $C_3$.

The present commercially produced parallel path nebulizers are not able to work for flows of 0.1 ml/min or lower. Typical parallel path nebulizers are operated at 1 to 2 ml/min liquid flow rates, with 0.5 to 2 liter/minute of gas flow. Improvements in spectrometers have led to a need for improved atomization and a large range in liquid flow rates. Spectrometers benefit from atomization of liquids into very tiny droplets, ideally with the majority being 10 micron diameter or less. Smaller droplets produce better spectrometer results. Inductively Coupled Plasma Mass Spectrometers (ICP/MS) require flow rates of 0.1 to 0.5 ml/min. Combining ICP spectrometers with other analytical methods, such as chromatography and capillary electrophoresis, has created requirements from 0.1 ml/min liquid flow down to 0.001 ml/min or lower.

Other applications have led to the requirement for nebulizers to be able to run higher flow rates. Several industrial processes have required the advantages of the non-plugging parallel path design, in the range of 20 to 100 ml/min. Other processes in development are designed to provide many liters per minute capability.

It is desirable to have a single device capable of atomizing liquids over a large range of flow rates. Some concentric nebulizers have a larger working range of flows than the conventional parallel path method and designs. In U.S. Pat. No. 6,166,379 to Montaser et al., a device is disclosed that handles 1 to 100 microliters/minute liquid flows. However concentric nebulizers for spectrometers have been found to easily plug and break, and commonly have severe salting problems. Most nebulizer designs are typically limited in the flow rates, and usually have a specific best-flow for a narrow range. For most analytical nebulizers, the manufacturers usually have different models for each flow range. For instance, one concentric nebulizer manufacturer has 5 models, one for each flow range of 20 μL/min, 50 μL/min, 100 μL/min, 400 μL/min and 2 ml/min.

It would be preferable for the user to be able to have one nebulizer that provides excellent atomization, runs all of the desired ranges so that they can change the sample flow rates without having to change the nebulizer and that is as resistant to plugging and salting as the conventional parallel path method and devices.

BRIEF SUMMARY OF THE INVENTION

The embodiments of the present invention are directed to nebulizing methods and systems that produce improved atomization with a larger portion of small droplets than a conventional parallel path method and system. The present invention utilizes one nebulizing device that operates for a very large range of liquid flow rates, so that the sample flow rates can be easily changed within the nebulizing system. It is therefore an object of the present invention to provide an enhancement to the parallel path methods and systems of dispersing liquids in a gaseous medium. More particularly, the present invention provides atomization in a uniform liquid spray of very small liquid drops for a large range of liquid flow rates. Furthermore, atomizing devices are provided which are able to operate at very low liquid flow rates and other, similar but larger, devices are able to operate at very high liquid flow rates. The systems and methods also allow designs for such nebulizers to be able to be manufactured with minimal effort, and with minimal parts.

The conventional parallel path methods and systems utilizes the induction of liquids into a gas stream from an orifice, with the feature of a simple, though unique, method of delivering the liquid to the gas orifice. The present invention provides an enhancement which utilizes shaping of the gas orifice and liquid interface for optimum atomization. The conventional parallel path system allows for the usage of any material, regardless of its ability to wet; to be able to work in any orientation; to have unrestricted flow in the liquid path which prevents plugging; and to prevent the alignment of the gas and liquid passages from being critical. The present invention allows all of the features of the conventional parallel path methods and systems and also allows the liquid exit area to be any size relative to the gas orifice while still producing a smaller droplet size in the mist.

The present invention provides a process for atomizing liquids at an interface between the liquid and an ambient gas or air. The present method comprises the steps of providing: a gas stream in close proximity to the liquid, directing said gas stream away from the surface of the liquid, having a gas orifice shaped so that the liquid is induced to extend past the slower moving gas at the outer edge of the gas stream to a faster, more central portion of the gas stream, being broken up into aerosol particles, and atomizing the liquid into a gaseous medium as a fine, highly consistent and uniform dispersion.

A nebulizing device according to an embodiment of the present invention comprises a liquid passage, a gas and liquid interface, and a gas passage. The liquid passage delivers a liquid to an exit area of said nebulizer, said liquid passage having a predetermined diameter equal to or smaller than a natural diameter of a free drop of said liquid so that said liquid stretches across said exit area by surface tension effects; or said liquid passage having a diameter larger than a natural diameter of a free drop but having a liquid flow rate or an orientation such that the liquid occupies said exit area and remains close to the gas stream. The interface shall be for focusing the liquid flow between the liquid passage and the gas passage, and to enable the liquid and gas interaction to occur in a faster more central portion of the gas stream rather than the slower outer portion of the gas stream. The interface comprises a wall between the liquid passage and the gas passage and is shaped at the gas orifice in the form of a spout with the wide part extending towards the liquid and the small part extending towards the gas. The gas passage shall be for supplying a gas stream to a gas orifice thereof, said gas orifice placed in close proximity to said exit area so that the spout of the interface shall extend into the gas passage. The interface shape directs the liquid to the higher velocity portion of the gas stream and enables the higher velocity portion of the gas stream to impart energy to the liquid, pushing the liquid away from the gas orifice and causing the liquid to break up into a fine, highly consistent and uniformly dispersed mist.

Other aspects, features and advantages of the present invention are disclosed in the detailed description that follows.

BRIEF DESCRIPTION OF THE SEVERAL VIEWS OF THE DRAWING

The invention will be more fully understood by reference to the following detailed description of the invention in conjunction with the drawings, of which.

DETAILED DESCRIPTION OF THE INVENTION

Figure 3:
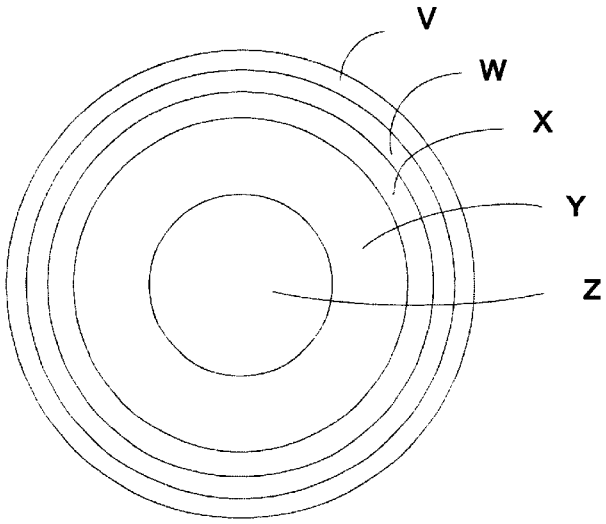
FIG. 3 illustrates flow rate zones of a gas or liquid fluid in a passage.
Figure 4:
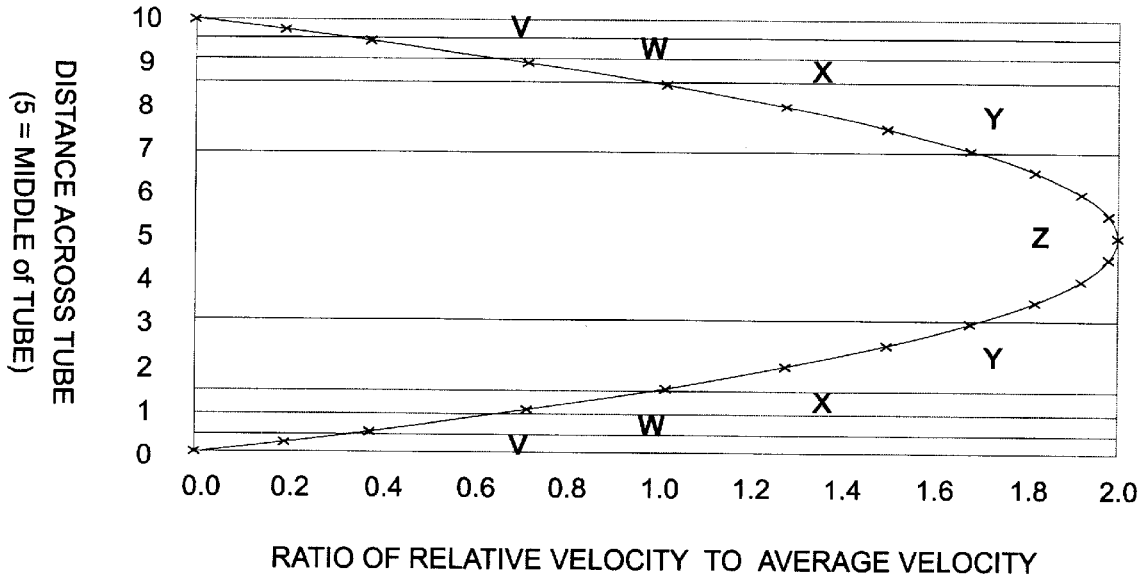
FIG. 4 illustrates a graph of fluid flow velocity along a passage.

According to embodiments of the present invention, enhanced parallel path nebulizing systems and methods are provided such that an interface between a gas orifice and a liquid exit area is shaped to focus the liquid flow to the center of the gas stream. FIG. 3 illustrates an example of a cross section showing flow rate zones in a circular cross section fluid passage. The flow zones are shown as five concentric regions V, W, X, Y and Z, progressing from the outer most region V to the inner most region Z. A graph of the relative velocity at each of these regions within the flow zone is shown in FIG. 4. Fluid flow in a passage follows Poiseuille's Law forming a parabolic flow pattern for the relative velocity distribution of a fluid flow (either gas or liquid). The gas or liquid in region V nearest to the wall of the passage shown is moving at 0 to ⅓ of the average velocity. The fluid in region W, which is closer to the center of the flow zone, increases in the fluid movement between ⅓ to ⅔ of the average velocity. In region X, the fluid movement further increases between ⅔ to the average velocity. The fluid movement further increases in region Y between 1 to 1.75 of the average velocity. In the inner most region, region Z, the fluid movement increases even more to between 1.75 and 2 times the average fluid flow. The parabolic line provides a "best fit line" for the calculated values of these relative velocities. The interaction between gas and liquid in conventional circular gas orifice designs occurs in region V. Preferably, region Z is the area that interaction with the liquid is desired. However, a significant enhancement to the liquid interaction is still achieved in region Y in comparison to interactions in regions V and W. The embodiments of the present invention are directed to utilizing the increased fluid movement of the inner regions of the flow zone so that a fine, highly consistent and uniformly mist results.

Parabolic flow in a gas stream causes the outside portion of a gas stream to flow slowly, and the center to flow rapidly. With a properly shaped gas orifice, the liquid can be brought into contact with a faster moving portion of the gas stream and accordingly be imparted with significantly more energy by the gas stream. This causes the liquid to break up into smaller particles than otherwise would be possible. With the addition of a small spout into the gas stream, low liquid flows are introduced into the gas stream in the fastest portion of the gas stream, causing even very low flows to be impacted with the highest energy possible, and enabling very low flows to be atomized. With the center portion of a gas stream moving at approximately three times the speed or more of the outer 20% of the gas stream, the energy imparted is the square of the velocity or nine times or more what the liquid would receive if reacting with the outer portion of the gas stream. With the system and method according to the embodiments of the present invention, induction of the liquid into the gas stream may not be as significant in producing atomization as the direct transfer of energy from the gas stream to the liquid.

This can significantly improve the aerosol and increase the range of liquid flow rates over which the nebulizer works. With properly shaped gas and liquid interfaces, the parallel path system and method can be extended to include very large and very tiny liquid flow rates in a single nebulizing device. Very large diameter liquid passages can be used if the liquid flow rate is sufficient to maintain a reasonably constant liquid level near the gas orifice. Also, miniature nebulizers and micro-nebulizers can be made with extrusion methods and microchip techniques. With this system and method according to the embodiments of the present invention, there may not be any limits to size of nebulizers possible, nor any limits to liquid flow rates for atomization.

Conventional parallel path nebulizers for analytical usage have been produced with a simple, round gas passage and orifice. This has provided nebulizers that were difficult to plug, as intended, but the liquid sample flow ranges were generally limited, and usually were required to be 1.5 ml/min to 2 ml/min. Their maximum rage was in the 0.5 to 2.5 ml/min range. Below 0.5 ml/min, the nebulizers usually would provide poor or no atomization. When the flow range rises above 2.5 ml/min, the nebulizing devices typically begin to "spit".

In attempts to produce lower liquid flow rates, smaller liquid capillaries were tried. This was successful, but it was difficult to machine the smaller capillaries. With the usage of multilumen extruded Polytetrafluoroethylene (PTFE) or Teflon tubing press fit into larger bodies, very small capillaries became possible for enabling lower liquid flow rates. This design also led to providing for the capability of working with the gas orifice shape, and led to the development of shapes that enhanced the quality of the mist and expanded the range of flow rates. This improved shaping of the gas orifice and liquid interface was then successfully applied to larger nebulizers, for enabling simple, large liquid flow rate, and non-plugging nebulizers to be produced.

The parallel path method as described in U.S. Pat. No. 5,411,208 to Burgener lists the gas orifice as being able to be just inside the liquid passage, on the edge or just outside the liquid passage. In practice, the location of the gas orifice has little effect on the quality of the mist as long as the gas orifice is close enough to the liquid passage to contact the liquid and begin interacting with the liquid. The actual distances from the liquid passage depend on the material used. The parallel path method enables devices to be made with non-wetting materials such as Teflon, but they also work well with wetting materials such as glass, metals and plastics. If the material is non-wetting, the gas orifice needs to be closer to the liquid passage than if the material is wetable. With a wetable material, the liquid spreads out from the liquid passage in all directions for a while before forming drops, and if the gas orifice is within this range, the liquid will make contact with the gas stream, and be drawn into the gas stream, and will form a path to the gas stream maintaining contact and flow from the liquid passage to the gas stream.

From observations of the liquid and gas interaction under a microscope, it is apparent that the liquid interacts with the outside edges of the gas stream and the portion with which it first comes into contact. Depending on liquid flow rates, gas flow rates and types of liquid, the liquid can in some instances be seen to flow up the gas stream for a short distance before beginning to break up into small droplets. The distance is tiny, on the order of the diameter of the gas orifice. However, it clearly indicates that the gas and liquid interaction is essentially occurring on the outer portion of the gas stream.

When the liquid droplets have begun to spread into the rest of the gas stream, the gas stream has already begun to spread and slow. Typically a gas stream will spread out at a 15 degree angle to about double the diameter of the gas orifice after moving 3.75 diameters away from the gas orifice. At double the diameter, the cross section of the gas stream is 4 times the area of the gas orifice, and the gas stream velocities are approaching ¼ of the speed at the orifice. As the liquid interacts with the outside of the gas stream and rises up in the gas stream for a distance before interacting with the central portions of the gas stream, the energy of the gas stream imparted to the liquid is minimal. If the liquid can be enabled to interact with the center of the gas stream where the energy levels of the gas stream are much higher, the liquid will be broken into much smaller droplets or into a higher proportion of smaller droplets than otherwise possible.

As discussed above, the gas capillary or passage can be of any cross section, and does not need to be circular. The effect of drag along the inner walls of a gas passage is similar regardless of the shape of the cross section of the passage. For simplification of the process described here, circular cross sections will often be used in the discussions that follow. However, any shape of gas passage cross section may be used. The criteria of importance for the passage cross section are: that the gas flow be laminar (non-turbulent); the gas passage be straight, tapered, or expanding smoothly so that the gas flow remains laminar; and that the gas orifice be shaped differently from the main passage so that the liquid interface interacts with the faster moving portion of the gas stream rather than the slower portion at the edge of an orifice as it would if the orifice was the same cross sectional shape as the passage.

A tapered gas passage will achieve some of the effect, as the slower portion of the gas flow will be somewhat blocked by the tapered portion of the gas passage, allowing the faster moving portion to continue with minimal blocking, so that the gas exiting at the orifice is moving faster than what would occur in a straight passage. However, the benefit of tapering is small compared to the benefits of a passage with a shaped orifice. The drag due to the taper is extensive, and the gas exiting still follows Poiseuille's Laws with a slow portion at the outside of the gas flow and a faster portion at the center. The drag due to a properly shaped orifice and spout is very tiny and causes little loss of energy to the gas flow. Shaping an orifice to deliver the liquid to the fastest portion of the gas flow works well for any shape passage (expanded, tapered, curving, irregular or straight) as long as the passage has higher velocity gas in the center.

From Poiseuille's Law of fluid flow in capillaries (for non-turbulent fluid flows), gas flow follows a parabolic velocity distribution across the capillary. The gas flow at the edges of a capillary is moving very slowly, essentially at zero velocity. The gas flow in the center moves at twice the average flow rates. The formula is $V(r)=P\ (a^2-r^2)/4Ln$, where V(r) is the velocity at radius r, P is the pressure, a is the radius of the capillary, L is the length of the capillary and n is the viscosity. The velocity distribution goes from 0 at the edges to twice the average velocity at the center. The first 20% of the distance from the edge to the center has velocities less than ⅓ the velocity of the gas at the center. With a parabolic distribution, the velocity is near maximum for a large region near the center. Energy is related to the square of the velocity ($E=\frac{1}{2}mv^2$). For instance, an increase of three times the velocity results in an increase of nine times the energy. Accordingly, it is of very significant advantage to be able to have the liquid interact with the central portion of a gas stream rather than with the outside edge.

Note that Poiseuille's Law applies for capillaries much larger in cross section than the mean free path of the fluid molecules. As the cross sections of the capillaries decrease, the flow at the edges increases in velocity and the flow at the center decreases relative to the average flow rates. For capillary cross sections less than 100 times the mean free path of the molecules, the flow patterns are more accurately described by A. Beskok and G. E. Karniadakis, *Models and Scaling Laws for Rarefied Internal Gas Flows Including Separation*, presented at the $48^{th}$ Annual Meeting of the American Physical Society Division of Fluid dynamics, Irvine, Calif., Nov. 19–21, 1995. This flow model shows the effects of very small capillaries and rarified gases on velocity distributions. As the mean free path becomes larger compared to the diameter of the capillary cross section, the gas at the edges begins to move faster and the gas in the center moves slower relative to the average velocity, and eventually approaches a constant velocity across the capillary. With gases running in the 50–100 nanometer ($10^{-9}$ m) range for their mean free path at atmospheric pressure and room temperatures, capillary cross sections would have to be in the order of $10^{-7}$ m ($10^{-5}$ cm or $4\times10^{-6}$ inches) in diameter before the advantages of this parallel path enhancement significantly decreases. The parallel path system still works with such very tiny capillaries, but the present enhanced parallel path system does not realize significant advantageous enhancements for such very tiny capillaries as with larger capillaries.

With a gas orifice the same shape as the gas passage, the liquid interacts with the outside of the gas stream, and receives minimal energy from the gas stream. With the gas orifice shaped properly, the liquid can be directed past the slower moving outside of the gas stream into the faster moving central portion of the gas stream. Any change in shape will cause turbulence in the gas stream, and decreases the gas velocities. However, with a minimal, smooth interface between the round portion of the capillary and the orifice, the turbulence will be minimal and advantageous enhancements will be achieved.

The shape of the gas orifice on a circular passage can be as simple as a half moon shape and a crescent shape, or more complex such as a "teapot's spout" shape. With the main advantages gained by introducing the liquid at just 20% of the radius of the capillary cross section into the gas stream, the shape change at the orifice can be small and still have a large advantage. For instance, for a capillary cross section that is 10 thousandths of an inch in diameter, 20% of the radius is 1 thousandth of an inch. An indentation of 4 to 6 thousandths would carry the liquid to the fastest portion of the gas stream, but even an indentation in the orifice of 1 thousandth of an inch is sufficient to significantly increase the energy imparted to the liquid.

Figure 5A:
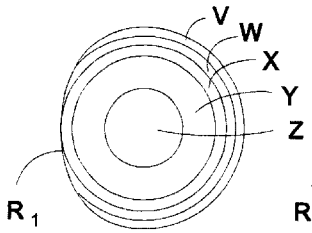
FIGS. 5A–5F illustrate distortions to a circular gas passage according to embodiments of the present invention.
Figure 5B:
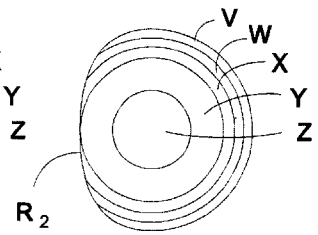

FIGS. 5A–5F illustrate embodiments of the present invention which distort a circular gas orifice for a circular gas passage in achieving the improved dispersion of liquids into a gaseous medium over a large range of liquid flow rates. In FIG. 5A, a cross-section of the fluid flow zones for a circular orifice is shown. Minor flattening $R_1$ of the orifice sufficiently bypasses the two slowest moving fluid flow regions V and W. Accordingly, the fluid is directed to flow into the faster moving regions X, Y and Z, which improves the dispersion of the fluid. In FIG. 5B, an orifice is provided with a greater flattening $R_2$ of the orifice for sufficiently bypassing the three slowest regions of the fluid flow, regions V, W, and X. Here, the fluid flow is improved even more than realized by the orifice of FIG. 5A because the fluid flows only in the two fastest moving regions Y and Z. In FIG. SC, the fluid flow is improved even more by increasing the flattening $R_3$ to bypass regions V, W, X, and Y so that the fluid flows only in the fastest moving area, region Z.

Figure 5C:
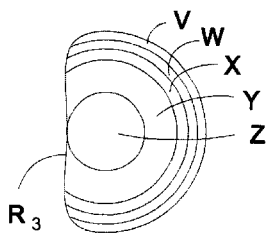
Figure 5D:
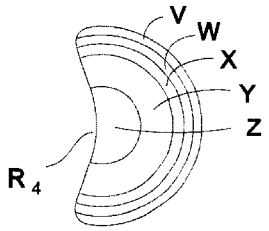
Figure 5E:
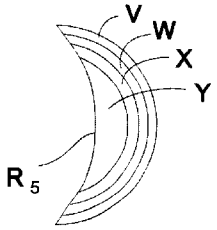
Figure 5F:
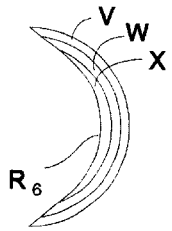

The designs of orifices shown in FIGS. 5D, 5E, and 5F are all effective in improving the gas and liquid interaction by bringing the liquid to the faster portions of the fluid flow in the flow zone. The crescent shaped distortions of the circular shaped orifices in FIGS. 5E and 5F still deliver the liquid to a gas flow area near the average speeds so it is still effective in improving the gas and liquid interaction. In practice, the orifices of FIGS. 5C, 5D, and 5E are the most effective and are easiest to produce.

Figure 6A:
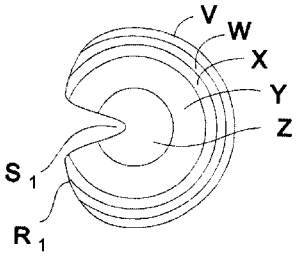
FIGS. 6A–6D illustrate spouts and distortions for circular gas passages according to embodiments of the present invention.
Figure 6B:
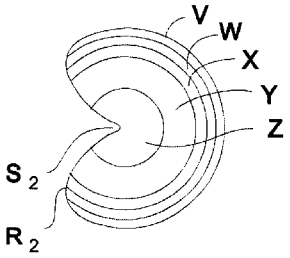
Figure 6C:
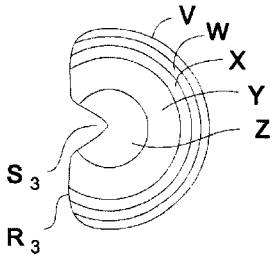

FIGS. 6A–6D illustrate spouts and distortions of circular gas orifices according to embodiments of the present invention. In FIG. 6A, minor flattening $R_1$ of an orifice is sufficient to bypass the two slowest moving regions V, and W so that the gas flows in the faster regions X, Y and Z. A spout $S_1$ is also provided that reaches into the fastest moving portion of the gas flow, region Z, for improving the dispersion of liquids in a gaseous medium. Greater flattening $R_2$ of an orifice is shown in FIG. 6B for bypassing the three slowest moving regions V, W, and X so that the gas flows in the two fastest regions Y and Z. A spout $S_2$ is also provided so that the gas can reach into the fastest moving portion, region Z, of the gas stream. Similarly, orifices of FIGS. 6C and 6D have greater flattening $R_3$ and $R_4$ and spouts $S_3$ and $S_4$, respectively, for bringing the liquid to the fastest regions of the flow zone.

Figure 6D:
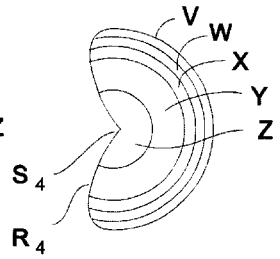
Figure 7:
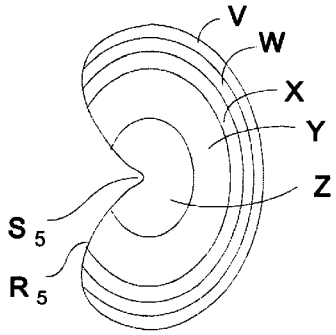
FIG. 7 illustrates a spout and distortion for an elliptical gas passage according to an embodiment of the present invention.
Figure 8:
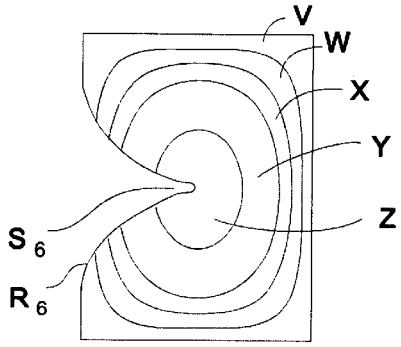
FIG. 8 illustrates a spout and distortion for a rectangular gas passage according to an embodiment of the present invention.

FIG. 7 illustrates another embodiment of the present invention for an elliptical gas orifice. Flattening $R_4$ and spout $S^5$ are provided for this elliptical gas orifice for bringing the liquid to the faster regions of the flow zone. FIG. 8 illustrates a rectangular gas orifice according to another embodiment of the present invention. Similar to the elliptical orifice, flattening $R_6$ and spout $S_6$ are provided for bringing the liquid to the faster regions of the flow zone. In each of the circular, elliptical and rectangular orifice variations, the liquid flow is delivered to the faster regions of the gas flow to achieve about the same improvement for the liquid dispersion. However, for high flows, the circular gas orifice with the flattening $R_4$ shown in FIG. 6D provides the best overall performance across high and low flows in a single nebulizing device.

Figure 9A:
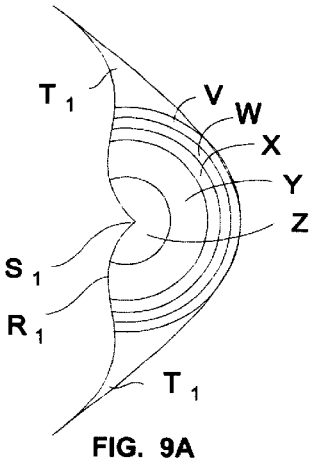
FIGS. 9A–9C illustrate spouts and distortions of gas passages utilizing extensions at the crescent ends similar in shape to the spikes on the heads of some trilobites according to embodiments of the present invention.
Figure 9B:
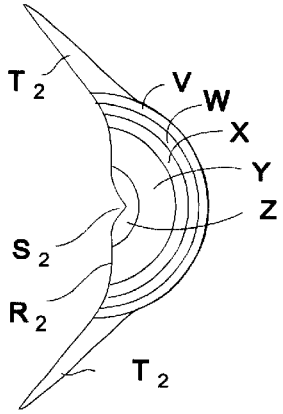
Figure 9C:
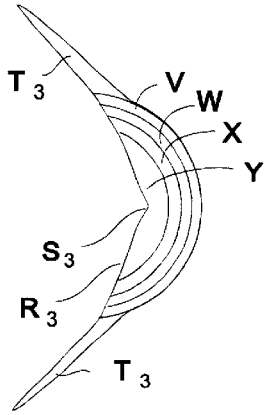

FIGS. 9A, 9B, and 9C illustrate gas orifices having spikes similar in shape to spikes on the heads of some trilobites according to further embodiments of the present invention. The "trilobite spikes" cause some portions of the gas to flow away from the gas orifice and create a barrier to the liquid flow. As a result, the build up of droplets on the edge of the orifice is reduced which prevents spitting of such droplets. In FIG. 9A, an orifice having trilobite spikes $T_1$ includes flattening $R_4$ and spout $S_4$ in a similar design to the circular orifice of FIG. 6D. The respective orifices having trilobite spikes $T_2$ and $T_3$ of FIGS. 9B and 9C further squeeze the orifices by providing flattening $R_5$ and $R_6$, and spouts $S_5$ and $S_6$. Each of these embodiments produces similar atomization results. In practice, the orifices of FIGS. 9A, 9B, and 9C are minor modifications of the orifice shapes shown in FIGS. 6A–6D. They are easily produced by simply adding the spikes to the orifice shapes of FIGS. 6A–6D.

Figure 10A:
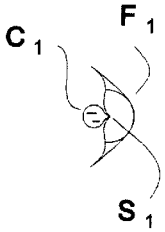
FIGS. 10A–10D illustrate various sized liquid passages for gas liquid interfaces according to embodiments of the present invention.
Figure 10B:
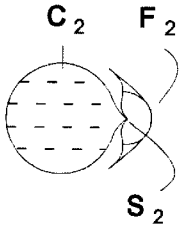
Figure 10C:
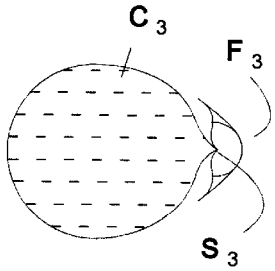
Figure 10D:
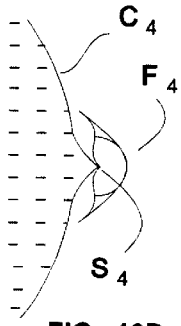

FIGS. 10A, 10B, 10C, and 10D illustrate designs of the gas orifice and liquid exit areas according to embodiments of the present invention. In FIGS. 10A–10D, gas orifices are provided in a similar shape as described in FIG. 9A with liquid passages tied into spouts of the gas orifices. In the embodiment illustrated in FIG. 10A, a liquid passage $C_1$ is provided that is much smaller than the gas orifice $F_1$. The liquid passage $C_1$ is tied into a spout $S_1$ of the gas orifice $F_1$. FIG. 10B illustrates a liquid passage $C_2$ that is similar in size to a gas orifice $F_2$. The liquid passage $C_2$ is tied into a spout $S_2$ of the gas orifice $F_2$. In the embodiment illustrated in FIG. 10C, a liquid passage $C_3$ is provided that is slightly larger than a gas orifice $F_3$. The liquid passage $C_3$ is tied into a spout $S_3$ of the gas orifice $F_3$. In the embodiment illustrated in FIG. 10D, a liquid passage $C_4$ is provided that is very much larger than a gas orifice $F_4$. The liquid passage $C_4$ is tied into a spout $S_4$ of the gas orifice $F_4$. FIGS. 10A–10D show that the surface tension of the liquid, the wetability of the device material, the flow rate of the liquid and the rate and pressure of the gas flow are much less important factors in this design than in the conventional parallel path method. However, orientation may be important if the liquid passage is larger than the natural free drop size of the liquid. The configuration of the gas orifice 224 and the liquid interface determines the ability of the system to produce the desired atomization. The size and shape of the liquid passage 214 for the liquid body is not important. The gas and liquid interaction only depends on the gas and liquid interface shape, the gas flow rates, the liquid flow rates, and the ability of the liquid to provide a steady flow to the gas orifice and gas stream.

Figure 11:
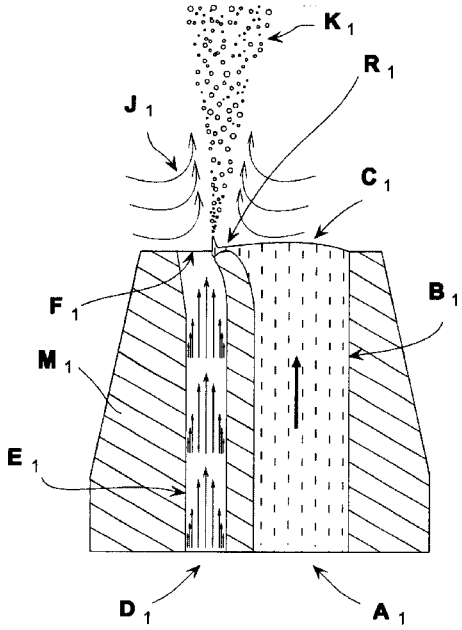
FIG. 11 illustrates a cross section of a nebulizing device having a circular shaped gas orifice with a minimal distortion according to an embodiment of the present invention.

FIG. 11 illustrates a detailed cross section near the gas and liquid interaction of a nebulizing device according to an embodiment of the present invention. The device includes a body $M_1$, a gas orifice $F_1$ and a liquid exit area $C_1$. The liquid passes through the liquid passage $B_1$ and the gas passes through gas passage $E_1$. An interface $R_1$ includes a gas orifice of a circular shape having a minimal distortion, similar to the distortion described in FIG. 5C. The gas orifice $F_1$ is slightly widened to move the slow gas flow a bit farther away from the central faster flow, which decreases any turbulence due to the distortion of the interface area $R_1$. Induction effects are indicated by arrows $J_1$ and the resultant atomized liquid $K_1$ is also shown.

Figure 12:
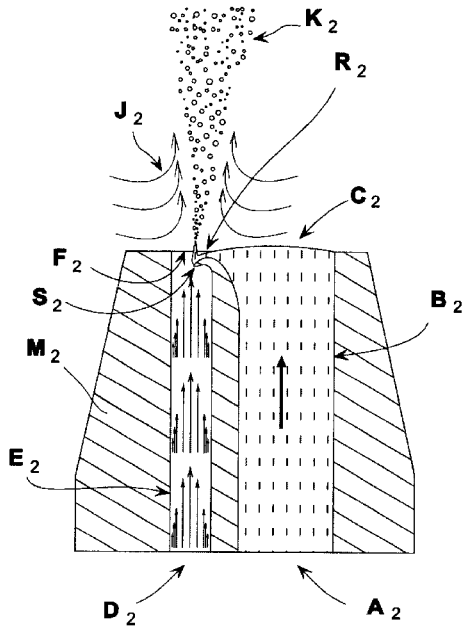
FIG. 12 illustrates a cross section of a nebulizing device having a circular shaped gas orifice with a larger spout and distortion according to an embodiment of the present invention.

FIG. 12 illustrates a detailed cross section near the gas and liquid interaction of a nebulizing device according to an embodiment of the present invention with a spout interface. The device is configured similar to FIG. 11 and like references are used for similar elements. In contrast to FIG. 11, a spout $S_2$ is provided at an interface $R_2$. The system of FIG. 12 is more difficult to manufacture as compared to the system of FIG. 11 but a larger range of liquid flow rates with effective atomization can be achieved by the system of FIG. 12.

Typically, with these enhancements, the shape of the gas orifice for a circular cross sectional passage ranges from slightly off circular, to flattened, to slightly concave towards the liquid, to a crescent shape orifice concave to the liquid. While it is apparent that many other shapes will produce similar results in enabling the liquid to interact with the higher velocity portion of the gas flow, the variations from near circular to crescent are the easiest to produce with the present mechanisms. For rectangular shaped gas passages, the orifice can be most easily modified by distorting one of the longest sides of the orifice. For irregular shape passages, one seeks the easiest portion to modify that will give the liquid access to the fastest moving portion of the gas stream.

With this method, the advantages of a shaped gas orifice are significant for small, medium and large changes. The presence of spouts or other shapes to deliver the liquid into the faster portion of the gas stream adds many more possible variations. The distortions to the gas orifice do not need to be precise or exact to achieve the effect, which allows a large selection of manufacturing means to accomplish the effect. It is generally very easy to modify the gas orifice in such a way as to improve the gas flow interaction with the liquid.

One caution in the production of the present nebulizing systems is that the modifications to the gas orifice should be minimal and smooth, so that there is minimal turbulence caused by the interface which would decrease the gas flow velocities past the interface. The presence of any material will necessarily create a drag on the gas flow, and will create some turbulence. A turbulence zone and slow gas flow due to drag from the spout will typically be very small and of no significant effect, but can be very large if the spout and interface are too large or not smooth.

It is apparent that any device that directs the liquid to the faster moving portion of the gas stream, or directs the faster moving portion of the gas stream to the liquid will achieve a similar effect. For instance, placing an object just outside of the gas orifice to re-direct the gas flow may have a similar effect to changing the shape of the gas orifice. However, changing the shape of the gas orifice is more efficient and easier to manufacture than baffles or other objects to redirect the gas flow. Also, changes in gas flow after the gas has exited the orifice will be less effective as the gas will begin to spread and decrease in velocity immediately. Shaping the orifice brings the liquid into contact with the gas stream before there is any expansion and loss of velocity so it is the most effective way to impart the energy from the gas stream to the liquid.

Where it is possible to produce a spout into a mid-portion of a gas stream (not at an orifice), it will be possible to produce atomization of the liquid within the gas stream. Although not the standard practice for nebulizers, it is beneficial for some applications such as for mixing a liquid into a chemical process line. In these discussions, references to orifices should be recognized to include such spouts in mid stream, with the tip of the spout being effectively the determining point for deciding where the "orifice" is. Effectively the spout is the nebulizer and the section of the gas stream where the spout is behaves like an orifice.

Figure 13:
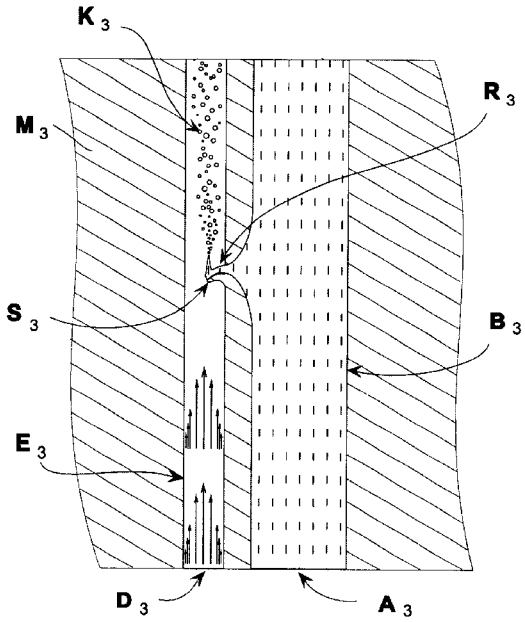
FIG. 13 illustrates a cross section of a nebulizing device having a spout extending into a gas stream according to an embodiment of the present invention.

FIG. 13 illustrates a detailed cross section near the gas and liquid interaction of a nebulizing device according to an embodiment of the present invention with a spout interface in a mid-portion of a gas stream. The device is configured similar to FIG. 12 and like references are used for similar elements. As in FIG. 12, a spout $S_3$ is provided at an interface $R_3$. In this embodiment, the spout extends into a gas stream in a mid section of the gas stream and not at an orifice. The locations of the liquid exit and gas exit are not important in this configuration.

Adding a "teapot spout" shape to the gas orifice helps lower flows arriving at the central portions of the gas stream without being caught up in the slower portions of the gas stream. The spout of the interface works best as a smoothly curving surface, extending from a wide part inside the liquid passage to a smaller part extending into the gas passage. For very low flows, a spout shaped similar to the teapot spout helps draw the liquid into the higher velocity portion of the gas stream. As with the teapot spout, the low flow spout should smoothly curve over its length and point down into the gas passage, and should be smallest at the tip extending into the gas passage. The size of the spout relates to the flow rates desired. A large spout is better for higher flow rates, a smaller spout for low flow rates. For large ranges of flow rates, a large spout with a tapered centerline can effectively produce both a large interface and a small interface. The radius of curvature of the spout does not seem to be critical as long as it is a smooth transition from the liquid passage into the gas passage.

For crescent shaped gas orifices on circular cross section passages, there can be some advantage in extending the gas orifice crescent tips for some length away from the gas orifice. This creates an appearance similar to spikes at the back end of a trilobite's head. This seems to decrease the formation of small droplets near the gas orifice, which would cause turbulence and disrupt the smooth interaction between the gas and the liquid. Similar spikes should be as effective for shaped orifices on non-circular passages.

According to embodiments of the present invention, very tiny nebulizers can be made with the parallel path method and system. For instance, microcircuit production techniques can be used to create two passages on a silicon wafer that meet at some point, with a minor non-linear interface. This will provide enough of a spout to allow the enhanced method to be of advantage as long as the passages are 100 or more times the mean free path. At atmospheric pressure for air, Nitrogen, and Argon, the mean free paths are in the order of 10 to 100 nanometers, so a passage of 1000 nanometers wide still has parabolic flow (1000 nanometers is 1×10−6 meter, 1/millionth of a meter). These nebulizers can be produced for even smaller passages, but the advantages of the orifice being modified from the gas passage cross section decrease as the passage width approaches the mean free path.

Figure 14:
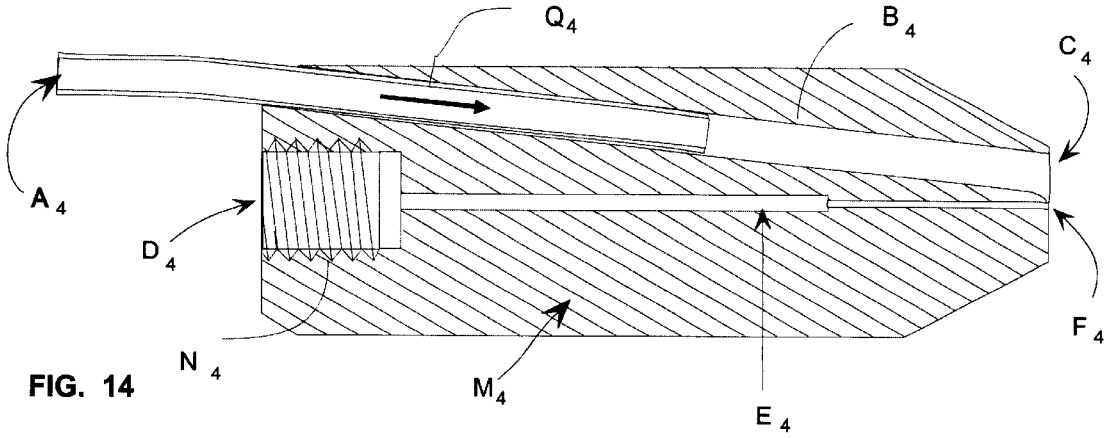
FIG. 14 illustrates a cross section of a nebulizing device according to one embodiment of the present invention.
Figure 15:
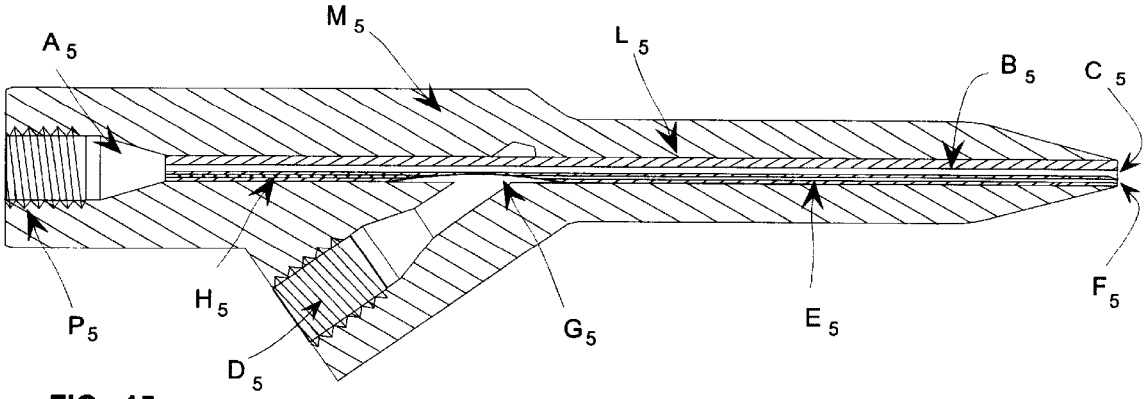
FIG. 15 illustrates a cross section of a nebulizing device according to another embodiment of the present invention.
Figure 16:
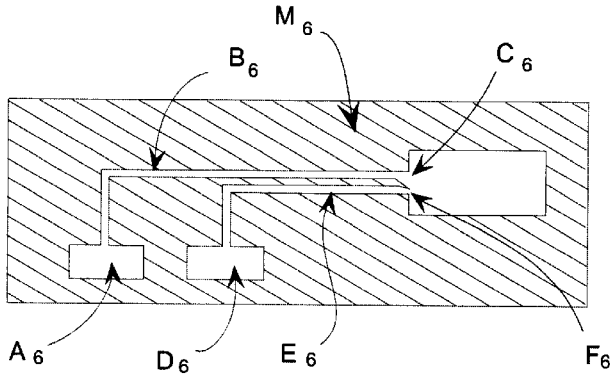
FIG. 16 illustrates a nebulizing device utilizing integrated circuit technology according to one embodiment of the present invention.

FIGS. 14, 15 and 16 illustrate some examples of nebulizing devices that may be utilized in the embodiments of the present invention. In FIG. 14, an enhanced parallel path nebulizer is shown that is able to atomize from 1 ml/min to 100 ml/min of liquid. The nebulizer includes a body $M_4$ having a gas orifice $F_4$ and a liquid exit area $C_4$. Gas is supplied to the gas orifice $F_4$ by connecting an external gas supply line $D_4$ to a connector $N_4$, such as a fitting screwed into the body $M_4$, for passing the gas through a passage $E_4$. Similarly, liquid is supplied to the liquid exit area $C_4$ by connecting an external liquid supply line $Q_4$ to an internal tube $B_4$. The external liquid supply line $Q_4$ may be press fitted into the body $M_4$ or attached with fittings. The large passage for the liquid creates some potential effects due to orientation but for higher flow rates, the orientation is not critical.

FIG. 15 illustrates an enhanced parallel path nebulizer according to another embodiment of the present invention that is able to atomize from flow rates of 1 microliter/min to 3,000 microliter/min. The nebulizer includes a body $M_5$ having a gas orifice $F_5$ and a liquid exit area $C_5$. To produce long and tiny capillaries, a multilumen extruded tube $L_5$ with two capillary holes, $B_5$ and $E_5$, running through the length of the tube is notched at notch $G_5$ and plugged at the back of the liquid passage $H_5$ and pulled into the body $M_5$. As a result, a liquid and gas tight press fit seal is produced between the multilumen tubing $L_5$ and the body $M_5$. Gas enters the device through a gas line $D_5$ to a gas connector $N_5$ and passes through the notch $G_5$ into the unplugged passage in the multilumen tubing $L_5$. The gas exits the device at the tip of the gas orifice $F_5$. The liquid travels the length of the body $M_5$ from the liquid supply line $A_5$ along the capillary $B_5$ to the liquid passage exit area $C_5$. The liquid supply line $A_5$ is attached at connector $P_5$.

FIG. 16 illustrates yet another embodiment for an enhanced parallel path nebulizer according to the present invention, which utilizes integrated circuit technology. In this embodiment, the nebulizer is etched onto a circuit board $M_6$. The etching provides a liquid passage $B_6$ for liquid supplied at pad $A_6$ and exiting at liquid exit area $C_6$. Similarly, a gas passage $E_6$ for gas supplied at pad $D_6$ and exiting at gas orifice $F_6$ is provided. It is appreciated that the present invention is not limited to only these above-described devices, and that these devices are provided as only some examples of nebulizing devices that may be used in conjunction with the present invention.

The results of the system and method according to the embodiments of the present invention have been significant for analytical nebulizers using the parallel path method. Previous designs of nebulizers produced fairly standard results compared to other nebulizer methods. Embodiments of the parallel path method according to the present invention have produced much larger portions of the mist in small droplets as compared to other known nebulizers. Comparisons of high pressure concentric nebulizers have shown that a modified parallel path method nebulizer running at 40 psi (2.7 bar, 270 kPa) produces a mist most comparable to a concentric nebulizer running at 160 psi (11 bar, 1100 kPa), and far superior in distribution of small droplet sizes to concentric nebulizers running at 40 psi. As most analytical instruments have a limit of a maximum of 45 to 50 psi pressure, being able to match the performance of a 160 psi device with a 40 psi device is unique, and very desirable.

The enhanced parallel path nebulizers according to the embodiments of the present invention have a very large range of liquid flow rates possible and some capable of producing good atomization over the range of 1 microliter per minute up to 3000 microliters per minute have been achieved, which is a range of 3000 times. The previous best range possible was only five times (from 0.5 to 2.5 ml/min). The liquid flow rate is independent of the atomization process. The present systems and methods do not produce any suction on the liquid, so the liquid must be delivered to the gas orifice through means such as gravity feed or pumping of the liquid. The operating range of the liquid flow is determined by the shape of the gas orifice, the gas flow rates and the surface tension of the liquid. Generally, liquids with lower surface tension will produce finer droplets.

The standard parallel path methods and systems enable nebulizers to be constructed with the gas orifice much smaller than the sample passage. In contrast, most nebulizers require a gas orifice of a similar size or larger size than the liquid passage. With the systems and methods according to the embodiments of the present invention, the gas orifice can be any size relative to the liquid passage, as the only significant portion of the liquid and gas interaction is occurring at the tip of the interface or spout in the gas orifice. As long as the liquid arrives to the tip in a steady flow, the nebulizer will produce a consistent atomization. So excellent atomization is possible with a very tiny liquid passage or a liquid passage having the same size as the gas orifice, or a very large liquid passage. The criteria is more dependent on flow rates than physical configuration of the body of the devices or the size of the liquid passages and the flow rates allowable for any device can work over very large ranges as previously described.

Most pneumatic nebulizers rely on induction to mix the liquid into the gas and achieve atomization. Induction occurs due to suction of lower pressure zones near the gas caused by the flow of the gas stream. This creates a gas flow or "wind" across the liquid, which draws the liquid into the gas stream, enabling the gas to impart its energy into the liquid, causing the liquid to break up into droplets. Induction occurs around any gas stream. Induction is important in the parallel path method. However, in the present system and method, induction does not seem to be the only factor occurring, and may not be the main factor. As liquids flow into the liquid passage, the liquid passage exit area is filled due to surface tension effects. The liquid will fill the passage whether or not the gas stream is flowing. As the liquid fills the passage, the interface between the liquid passage and the gas passage is also filled. With a spout extending into the gas passage, the liquid will flow along the spout and into the gas stream area. The liquid wets the spout or if the material is non-wetting, then the liquid fills the spout and begins to bead up. If the gas stream is turned on, the liquid on the spout will be impacted by the gas stream, and tossed into the direction of the gas stream's flow and break up into droplets.

As the liquid is tossed away by the gas stream, more liquid will flow onto the spout to fill the vacated area. The liquid will flow into the interface between the gas and the liquid both because it is inclined to do so due to surface tension spreading the liquid onto the spout as it would when there is no gas flow, and also due to the surface molecules being more tightly bound to each other than the non-surface molecules, so that as the surface molecules are impacted with the gas stream they move away from the liquid and pull the attached surface molecules after them into the gas stream. As the surface of the liquid is pulled towards the gas stream by the outgoing molecules, the liquid forms a "bridge" to the gas stream along which the surface of the liquid flows to the gas stream. Consider a swimming pool in which the skimmer which selectively allows the surface of the pool's water to flow into the filter, bringing all of the floating leaves and debris with it. The interface is acting much like a pool skimmer and causes the gas stream to pull the surface molecules into it, and then toss them away. As such, there is a direct interaction between the gas stream and the liquid, and induction may have little or no influence on the interaction.

It will be apparent to those skilled in the art that other modifications to and variations of the above-described techniques are possible without departing from the inventive concepts disclosed herein. Accordingly, the invention should be viewed as limited solely by the scope and spirit of the appended claims.

What is claimed is:

1. A process for atomizing liquids, comprising the steps of:

providing a gas stream which has an inner region and an outer region, the inner region having a higher velocity than the outer region of said gas stream;

providing a liquid in close proximity to said gas stream;

providing an interface in the form of a projection between said gas stream and said liquid that draws said liquid towards the faster inner region of said gas stream; and atomizing said liquid into a gaseous medium as a fine, highly consistent and uniform dispersion by breaking up said liquid into aerosol particles by interacting said liquid with said gas stream at said faster velocity towards said inner region of said gas stream.

2. A process for atomizing liquids directly from a surface of a body of a liquid at an interface between the liquid and a gas stream, comprising the steps of:

providing a gas stream through a gas passage to a gas orifice, the gas stream having an inner region and an outer region, the inner region having a higher velocity than the outer region;

providing a liquid in close proximity to the gas stream;

directing said gas stream away from the surface of the liquid;

providing an interface in the form of a projection between the gas stream and the liquid that draws or guides the liquid into the inner region of higher velocity of the gas stream;

impacting the liquid by the gas stream at a velocity higher than would occur if the liquid was interacting with the gas stream at the outer region of the gas stream;

breaking up the liquid into aerosol particles; and atomizing the liquid into a gaseous medium as a fine, highly consistent and uniform dispersion.

3. A process as claimed in claim 2, wherein said liquid is constrained in a passage, and said gas passage, said gas orifice, said liquid passage, and said interface are contained in a nebulizer body.

4. A process as claimed in claim 3, wherein said nebulizer body is formed of polytetraflouroethylene (PTFE), plastic, metal or glass.

5. A process as claimed in claim 2 further comprising the step of supplying said liquid by a pump or by a gravity feed.

6. A process for atomizing liquids directly from a surface of a body of a liquid at an interface between the liquid and a gas stream, comprising the steps of:

providing a gas stream through a gas passage to a gas orifice, the gas stream having an inner region and an outer region, the inner region having a higher velocity than the outer region of said gas stream, providing an interface in the form of a projection between the gas stream and the liquid by shaping the wall of the gas passage at the gas orifice so that a portion of the edge of the gas orifice extends into the higher velocity inner region of the gas stream;

providing a liquid in close proximity to the gas orifice;

directing said gas stream away from the surface of the liquid whereby liquid is drawn or guided along the portion of the edge of the gas orifice extending into the higher velocity inner area of the gas stream, and the liquid is impacted by the gas stream at a velocity higher than would occur if the liquid was impacted by the gas stream at the outer region of the gas stream;

breaking up the liquid into aerosol particles; and atomizing the liquid into a gaseous medium as a fine, highly consistent and uniform dispersion.

7. A process as claimed in claim 6, further comprising a spout extending from the interface and formed by a shaping of the wall of the gas passage at the gas orifice, the spout extending into the higher velocity area of the gas stream and focusing the liquid into a smaller interaction area than would occur without the spout whereby the liquid is capable of interacting with the higher velocity inner area of the gas stream.

8. A process as claimed in claim 6, wherein the gas passage is circular or oval and the interface between the gas stream and the liquid is the wall of the gas passage at the gas orifice, shaped to be a flattened circle or to be a half moon shape or to be a crescent shape.

9. A process as claimed in claim 8, further comprising an interface formed by shaping of wall of the gas, passage at the gas orifice and including a spout extending into the gas stream to enable the liquid to interact at a higher velocity near the inner area of the gas stream.

10. A nebulizing device comprising:

a liquid passage for receiving a liquid and delivering said liquid to a liquid exit area;

a gas passage for transmitting a gas stream, said gas stream having an inner region with a higher velocity flow compared to an outer region; and an interface formed by shaping the wall between the liquid and the gas stream or formed by the addition of an object that provides a spout or surface between said liquid exit area and said gas stream for conveying said liquid into said inner region of said gas stream so that said liquid interacts with a flow of said gas stream that is greater in velocity than an outer region of said gas stream and said liquid is atomized into a gaseous medium as a fine, highly consistent and uniform dispersion by breaking up said liquid into aerosol particles by interacting said liquid with said gas stream at said higher velocity towards said inner region of said gas stream.

11. A nebulizing device as claimed in claim 10, wherein said gas passage supplies said gas stream to a gas orifice said gas orifice being in close proximity to said liquid exit area.

12. A nebulizer apparatus comprising:

a liquid passage for delivering a liquid to a liquid exit area, said liquid passage having a predetermined diameter equal to or smaller than the diameter of a free drop of said liquid so that said liquid stretches across said liquid exit area by surface tension effects; or said liquid passage having a liquid flowing through the passage at a sufficient flow rate so that the liquid maintains said liquid exit area full; or said liquid passage being oriented in the apparatus such that said liquid in the passage fills the liquid exit area;

a gas passage, for supplying a gas stream to a gas orifice, said gas orifice placed in close proximity to said liquid exit area and said gas stream having an inner region with higher velocity flow compared to an outer region thereof; and an interface in the form of a projection formed by shaping the gas orifice or by shaping the wall between the liquid exit area and the gas orifice, said interface directing the liquid from the liquid exit area into the gas orifice such that the liquid interacts at the higher velocity inner region of the gas stream to form a fine, highly consistent and uniformly dispersed mist.

13. A nebulizer apparatus as claimed in claim 12, further comprising a nebulizer body including said liquid passage and said gas passage and said interface and a spout extending from the liquid exit area into the gas orifice as part of said interface.

14. A nebulizer apparatus as claimed in claim 12, wherein a diameter of said gas orifice is larger than the diameter of said liquid passage.

15. A nebulizer apparatus as claimed in claim 12, wherein a diameter of said gas orifice is the same size as the diameter of said liquid passage.

16. A nebulizer apparatus as claimed in claim 12, wherein a diameter of said gas orifice is smaller than the diameter of said liquid passage.

17. A nebulizer apparatus as claimed in claim 13, wherein said nebulizer body comprises polytetraflouro (PTFE), plastic, metal, or glass.

18. A nebulizer apparatus as claimed in claim 12, further comprising a liquid supply device for supplying the liquid to said liquid passage, said liquid supply device comprising a pump or a gravity feed.

* * * * *

UNITED STATES PATENT AND TRADEMARK OFFICE

CERTIFICATE OF CORRECTION

PATENT NO. : 6,634,572 B1 
DATED : October 21, 2003
INVENTOR(S) : John A. Burgener It is certified that error appears in the above-identified patent and that said Letters Patent is hereby corrected as shown below:

Title page,
Item [57], ABSTRACT, please insert the new ABSTRACT as follows:

-- ABSTRACT

A system and process for atomizing liquids at an interface between a liquid and a gas stream is provided. The system includes the steps of providing a gas stream in close proximity to the liquid, said gas stream having an inner region of higher velocity flow, and providing an interface between the gas stream and the liquid so that the liquid is induced to extend past the slower moving gas at the outer edge of the gas stream to the faster region of the gas stream, being broken up into aerosol particles, and atomizing the liquid into a gaseous medium as a fine, highly consistent and uniform dispersion. This system and method can significantly improve the aerosol and increase the range of liquid flow rates over which nebulizers operate.

Drawings,
Please substitute FIGS. 13-16 with the following new FIGS. 13-19;

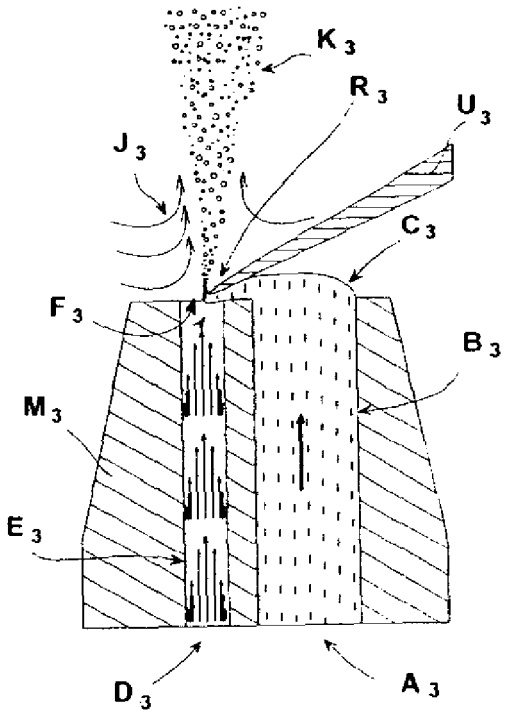

FIG. 13

UNITED STATES PATENT AND TRADEMARK OFFICE

CERTIFICATE OF CORRECTION

PATENT NO. : 6,634,572 B1 
DATED : October 21, 2003
INVENTOR(S) : John A. Burgener It is certified that error appears in the above-identified patent and that said Letters Patent is hereby corrected as shown below:

Drawings (cont'd),

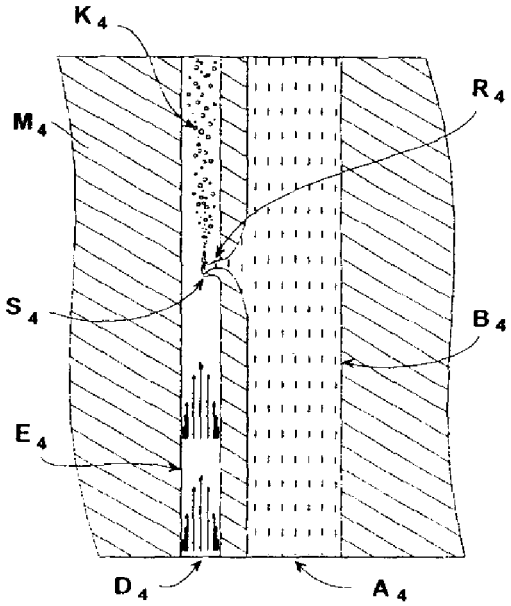

FIG. 14

UNITED STATES PATENT AND TRADEMARK OFFICE

CERTIFICATE OF CORRECTION

PATENT NO. : 6,634,572 B1 
DATED : October 21, 2003
INVENTOR(S) : John A. Burgener It is certified that error appears in the above-identified patent and that said Letters Patent is hereby corrected as shown below:

Drawings (cont'd),

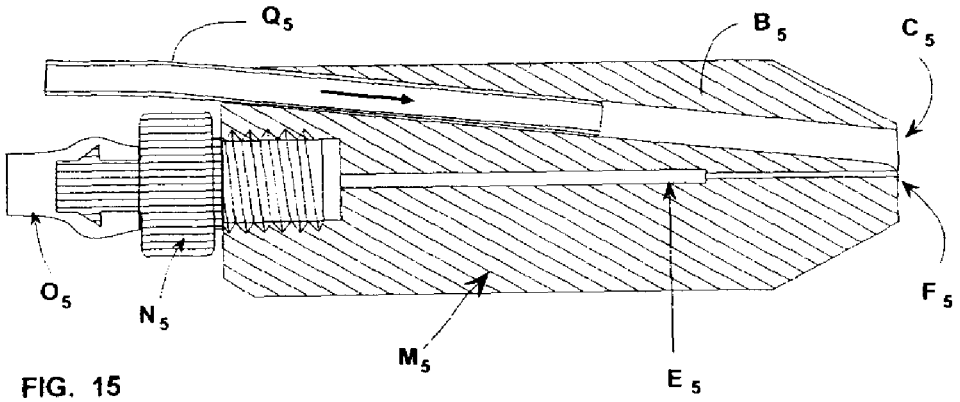

FIG. 15

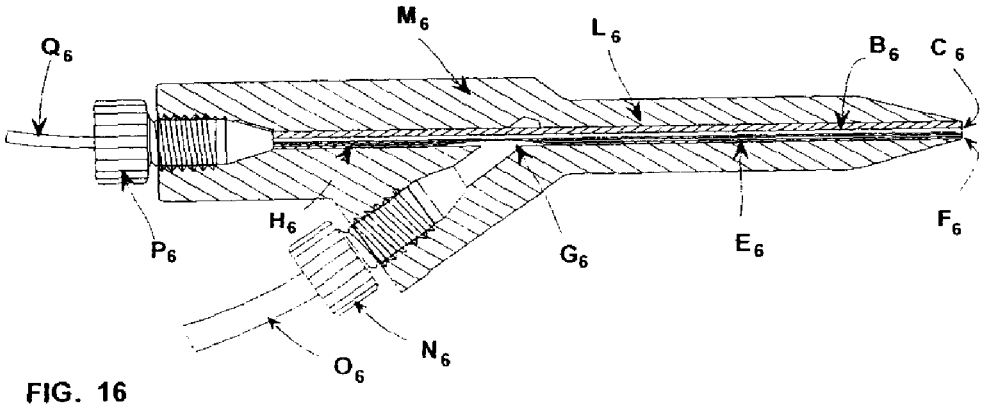

FIG. 16

UNITED STATES PATENT AND TRADEMARK OFFICE

CERTIFICATE OF CORRECTION

PATENT NO. : 6,634,572 B1 
DATED : October 21, 2003
INVENTOR(S) : John A. Burgener It is certified that error appears in the above-identified patent and that said Letters Patent is hereby corrected as shown below:

Drawings (cont'd),

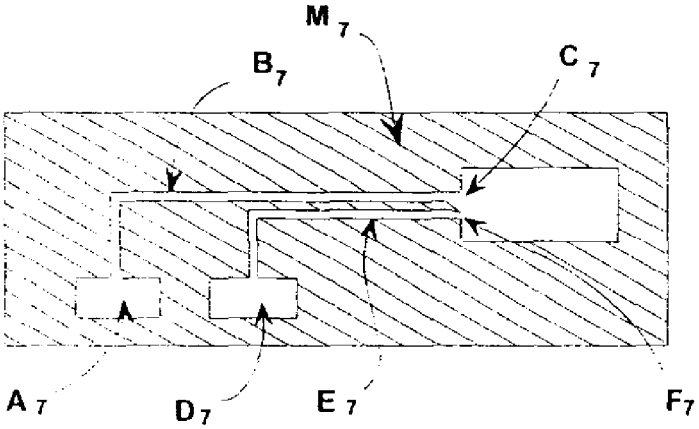

FIG. 17

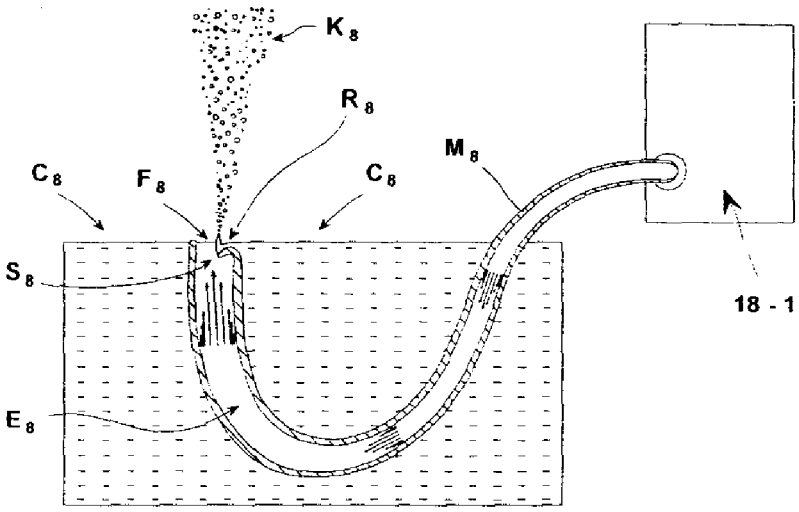

FIG. 18

UNITED STATES PATENT AND TRADEMARK OFFICE

CERTIFICATE OF CORRECTION

PATENT NO. : 6,634,572 B1
DATED : October 21, 2003
INVENTOR(S) : John A. Burgener It is certified that error appears in the above-identified patent and that said Letters Patent is hereby corrected as shown below:

Drawings (cont'd),

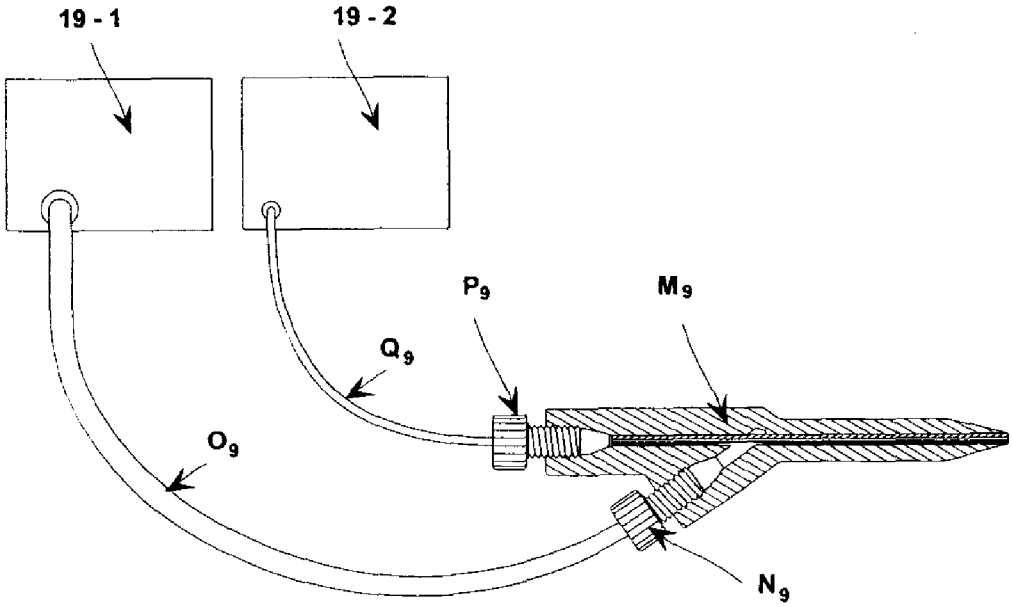

FIG. 19

It is certified that error appears in the above-identified patent and that said Letters Patent is hereby corrected as shown below:

Column 1, line 1 through Column 13, line 43,
Please delete and insert the new specification as follows:

TITLE OF THE INVENTION
ENHANCED PARALLEL PATH NEBULIZER WITH A LARGE RANGE OF FLOW RATES

CROSS REFERENCE TO RELATED APPLICATIONS
N/A

STATEMENT REGARDING FEDERALLY SPONSORED RESEARCH OR DEVELOPMENT
N/A

BACKGROUND OF THE INVENTION

Many methods and apparatus are known for atomizing liquids. Parallel path nebulizers have been used extensively for Inductively Coupled Plasma Spectrometer (ICP) sample introduction. A known parallel path nebulizer is disclosed in U.S. Patent No. 5,411,208 to Burgener. This nebulizing process and device independently brings the gas and liquid flow together with a gas orifice on or near the edge of the liquid path with the gas orifice being much smaller than the area of the liquid path.

Figure 1:
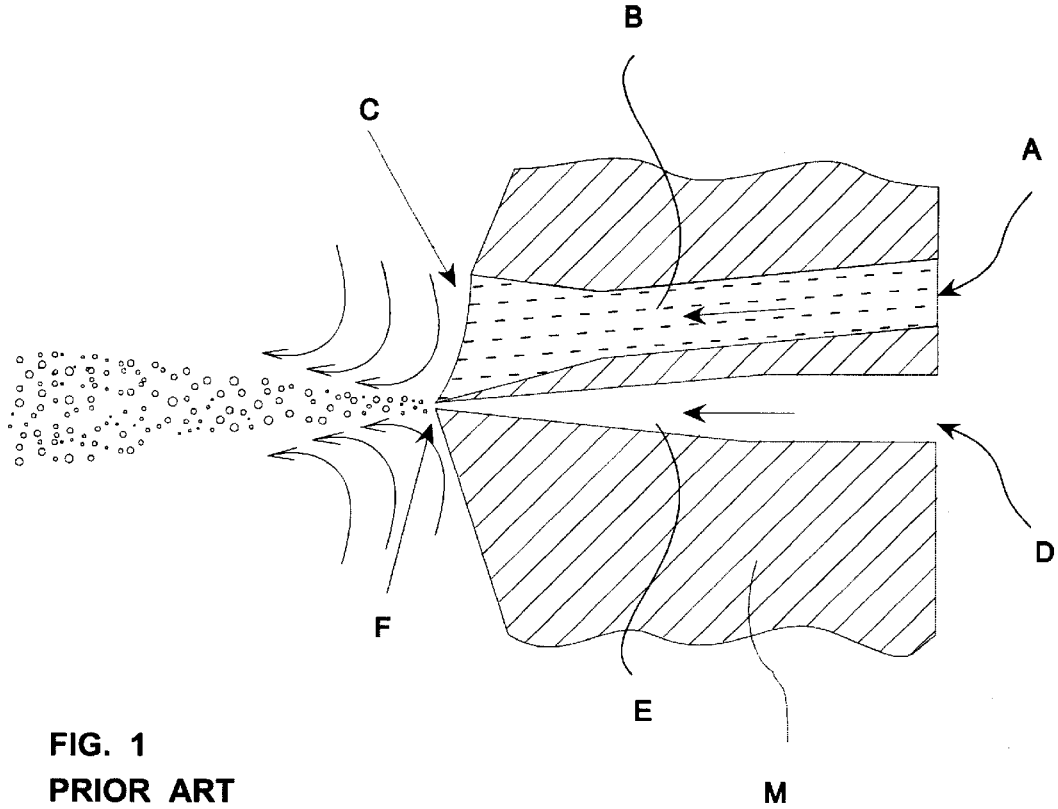
FIG. 1 PRIOR ART
FIG. 1 illustrates a conventional parallel path nebulizing device.

A cross section of this nebulizer is illustrated in Fig. 1 where liquid is supplied through a constrained liquid passage and gas is supplied to a gas supply passage A liquid exit area C and a gas orifice F are positioned so that the liquid is delivered close enough to be drawn into the gas stream. The nebulizer atomizes liquids directly from the surface of a body of liquid, using induction and the surface tension of a liquid to draw the liquid into the gas stream.

Figure 2A:
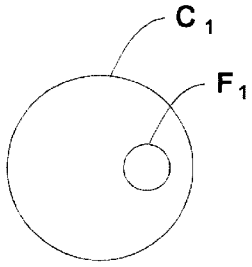
FIG. 2A PRIOR ART
FIGS. 2A, 2B, and 2C illustrate alignments of liquid exit areas and gas orifices for conventional parallel path nebulizing devices.
Figure 2B:
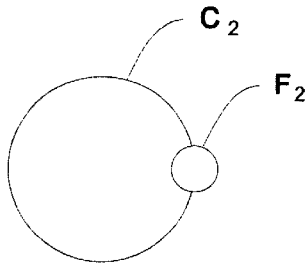
FIG. 2B PRIOR ART
Figure 2C:
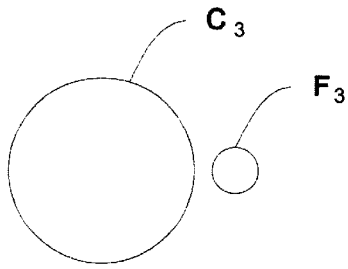
FIG. 2C PRIOR ART

Figs. 2A, 2B, and 2C illustrate liquid exit areas and gas orifice configurations for conventional parallel path nebulizers. Fig. 2A illustrates a gas orifice $F_1$ positioned inside of the liquid exit area $C_1$. Fig. 2B illustrates a gas orifice $F_2$ positioned on the edge of the liquid exit area $C_2$. Fig. 2C illustrates a gas orifice $F_3$ that is positioned just outside of the liquid exit area $C_3$.

The present commercially produced parallel path nebulizers are not able to work for flows of 0.1 ml/min or lower. Typical parallel path nebulizers are operated at 1 to 2 ml/min liquid flow rates, with 0.5 to 2 liter/minute of gas flow. Improvements in spectrometers have led to a need for improved atomization and a large range in liquid flow rates. Spectrometers benefit from atomization of liquids into very tiny droplets, ideally with the majority being 10 micron diameter or less. Smaller droplets produce better spectrometer results. Inductively Coupled Plasma Mass Spectrometers (ICP/MS) require flow rates of 0.1 to 0.5 ml/min. Combining ICP spectrometers It is certified that error appears in the above-identified patent and that said Letters Patent is hereby corrected as shown below:

Column 1, line 1 through Column 13, line 43 (cont'd), with other analytical methods, such as chromatography and capillary electrophoresis, has created requirements from 0.1 ml/min liquid flow down to 0.001 ml/min or lower.

Other applications have led to the requirement for nebulizers to be able to run higher flow rates. Several industrial processes have required the advantages of the non-plugging parallel path design, in the range of 20 to 100 ml/min. Other processes in development are designed to provide many liters per minute capability.

It is desirable to have a single device capable of atomizing liquids over a large range of flow rates. Some concentric nebulizers have a larger working range of flows than the conventional parallel path method and designs. In U.S. Patent No. 6,166,379 to Montaser et al., a device is disclosed that handles 1 to 100 microliters/minute liquid flows. However concentric nebulizers for spectrometers have been found to easily plug and break, and commonly have severe salting problems. Most nebulizer designs are typically limited in the flow rates, and usually have a specific best flow for a narrow range. For most analytical nebulizers, the manufacturers usually have different models for each flow range. For instance, one concentric nebulizer manufacturer has 5 models, one for each flow range of 20μL/min, 50μL/min, 100μL/min, 400μL/min and 2 ml/min.

It would be preferable for the user to be able to have one nebulizer that provides excellent atomization, runs all of the desired ranges so that they can change the sample flow rates without having to change the nebulizer and that is as resistant to plugging and salting as the conventional parallel path method and devices.

BRIEF SUMMARY OF THE INVENTION

The embodiments of the present invention are directed to nebulizing methods and systems that produce improved atomization with a larger portion of small droplets than a conventional parallel path method and system. The present invention utilizes one nebulizing device that operates for a very large range of liquid flow rates, so that the sample flow rates can be easily changed within the nebulizing system. It is therefore an object of the present invention to provide an enhancement to the parallel path methods and systems of dispersing liquids in a gaseous medium. More particularly, the present invention provides atomization in a uniform liquid spray of very small liquid drops for a large range of liquid flow rates. Furthermore, atomizing devices are provided which are able to operate at very low liquid flow rates and other, similar but larger, devices are able to operate at very high liquid flow rates. The systems and methods also allow designs for such nebulizers to be able to be manufactured with minimal effort, and with minimal parts.

It is certified that error appears in the above-identified patent and that said Letters Patent is hereby corrected as shown below:

Column 1, line 1 through Column 13, line 43 (cont'd),

The conventional parallel path methods and systems utilize the induction of liquids into a gas stream from an orifice, with the feature of a simple, though unique, method of delivering the liquid to the gas orifice. The present invention provides an enhancement which is derived from having the liquid interact with the gas stream's higher velocity flow in the inner part of the gas stream. The conventional parallel path system allows for the usage of any material, regardless of its ability to wet; to be able to work in any orientation; to have unrestricted flow in the liquid path which prevents plugging; and to prevent the alignment of the gas and liquid passages from being critical. The present invention allows all of the features of the conventional parallel path methods and systems and also enables the liquid flow rates to vary over a much larger range; allows the liquid exit area to be any size relative to the gas orifice; and produces smaller droplets in the mist.

The present invention provides a process for atomizing liquids at an interface between the liquid and a gas stream. The present method comprises the steps of: providing a gas stream in close proximity to the liquid, providing an interface between the gas stream and the liquid so that the liquid is induced to extend past the slower moving gas at the outer edge of the gas stream to a faster, more central portion of the gas stream, being broken up into aerosol particles, and atomizing the liquid into a gaseous medium as a fine, highly consistent and uniform dispersion.

A nebulizing device according to an embodiment of the present invention comprises a liquid passage, a gas and liquid interface, and a gas passage. The interface is the critical part.

The interface shall be for directing the liquid flow between the liquid passage and the gas passage, and to enable the liquid and gas interaction to occur in a faster more central portion of the gas stream rather than the slower outer portion of the gas stream. The interface may comprise a wall between the liquid passage and the gas passage that is shaped at the gas orifice in the form of a spout with the wide part extending towards the liquid and the small part extending towards the gas. Other forms of an interface may be a spout or shaped object not attached to the wall between the gas passage and the liquid passage but still directing the liquid into the higher velocity portion of the gas stream. The interface can work through the liquid wetting the interface and traveling along the interface into the gas stream through capillary action on the surface. For non wetting materials, the interface can use the surface tension effects of the liquid to direct the liquid to travel between portions of the interface. It is generally easier to work with wetable materials as the interface is easier to design. Very simple interfaces such as the tip of a pin extending into the gas stream may be all that is required for wetable materials. With non wetable materials one usually requires precise shaping of the interface according to the nature of the material and the liquids and how they interact.

It is certified that error appears in the above-identified patent and that said Letters Patent is hereby corrected as shown below:

Column 1, line 1 through Column 13, line 43 (cont'd),

The liquid passage delivers a liquid to an exit area of said nebulizer. If a liquid is allowed accumulate slowly on the tip of an object such as an eye dropper, the diameter of the drop just before it drips off the tip can be referred to as the diameter of a free drop. If the liquid passage and liquid exit area are smaller than the diameter of a free drop of the liquid then the liquid will fill the exit area simply from surface tension effects and the orientation of the device is not important. If the liquid exit area is larger than the diameter of a free drop, then the orientation and flow rates are important as the liquid can flow out of the exit area without coming into contact with the gas and liquid interface unless properly orientated or unless there is a high enough flow rate so that the liquid fills the exit area.

The gas passage supplies a gas stream to a gas orifice thereof, said gas orifice placed in close proximity to said exit area so that the spout of the interface shall extend into the gas passage.

Other aspects, features and advantages of the present invention are disclosed in the detailed description that follows.

BRIEF DESCRIPTION OF THE SEVERAL VIEWS OF THE DRAWING

The invention will be more fully understood by reference to the following detailed description of the invention in conjunction with the drawings, of which:

Fig. 1 illustrates a conventional parallel path nebulizing device;

Fig. 2A, 2B, and 2C illustrate alignments of liquid exit areas and gas orifices for conventional parallel path nebulizing devices;

Fig. 3 illustrates flow rate zones of a gas or liquid fluid in a passage;

Fig. 4 illustrates a graph of fluid flow velocity along a passage;

Figs. 5A-5F illustrate distortions to a circular gas passage according to embodiments of the present invention;

Figs. 6A-6D illustrate spouts and distortions for circular gas passages according to embodiments of the present invention;

Fig. 7 illustrates a spout and distortion for an elliptical gas passage according to an embodiment of the present invention;

Fig. 8 illustrates a spout and distortion for a rectangular gas passage according to an embodiment of the present invention;

Figs. 9A-9C illustrate spouts and distortions of gas passages utilizing extensions at the crescent ends similar in shape to the spikes on the heads of some trilobites according to embodiments of the present invention;

Figs. 10A-10D illustrate various sized liquid passages for gas liquid interfaces according to embodiments of the present invention;

Fig. 11 illustrates a cross section of a nebulizing device having a circular shaped gas orifice with a minimal distortion according to an embodiment of the present invention;

It is certified that error appears in the above-identified patent and that said Letters Patent is hereby corrected as shown below:

Column 1, line 1 through Column 13, line 43 (cont'd),

Fig. 12 illustrates a cross section of a nebulizing device having a circular shaped gas orifice with a larger spout and distortion according to an embodiment of the present invention;

Fig. 13 illustrates a cross section of a nebulizing device having a separate object providing the interface between the liquid and the gas stream rather than utilizing the gas orifice or the wall between the gas and liquid passages;

Fig. 14 illustrates a cross section of a nebulizing device having a spout extending into a gas stream according to an embodiment of the present invention;

Fig. 15 illustrates a cross section of a nebulizing device according to one embodiment of the present invention;

Fig. 16 illustrates a cross section of a nebulizing device according to another embodiment of the present invention;

Fig. 17 illustrates a nebulizing device utilizing integrated circuit technology according to one embodiment of the present invention;

Fig. 18 illustrates a nebulizing device according to another embodiment of the present invention; and Fig. 19 illustrates a nebulizing device as shown in figure 16 with attached liquid supply and gas supply.

DETAILED DESCRIPTION OF THE INVENTION

According to embodiments of the present invention, enhanced parallel path nebulizing systems and methods are provided such that an interface between a gas orifice and a liquid exit area is provided to direct the liquid flow to the center of the gas stream. Fig. 3 illustrates an example of a cross section showing flow rate zones in a circular cross section fluid passage. The flow zones are shown as five concentric regions V, W, X, Y and Z, progressing from the outer most region V to the inner most region Z. A graph of the relative velocity at each of these regions within the flow zone is shown in Fig. 4. Fluid flow in a passage follows Poiseuille's Law forming a parabolic flow pattern for the relative velocity distribution of a fluid flow (either gas or liquid). The gas or liquid in region V nearest to the wall of the passage shown is moving at 0 to 1/3 of the average velocity. The fluid in region W, which is closer to the center of the flow zone, increases in the fluid movement between 1/3 to 2/3 of the average velocity. In region X, the fluid movement further increases between 2/3 to the average velocity. The fluid movement further increases in region Y between 1 to 1.75 of the average velocity. In the inner most region, region Z, the fluid movement increases even more to between 1.75 and 2 times the average fluid flow. The parabolic line provides a "best fit line" for the calculated values of these relative velocities. The interaction between gas and liquid in conventional circular gas orifice designs occurs in region V. Preferably, region Z is the area that It is certified that error appears in the above-identified patent and that said Letters Patent is hereby corrected as shown below:

Column 1, line 1 through Column 13, line 43 (cont'd), interaction with the liquid is desired. However, a significant enhancement to the liquid interaction is still achieved in region Y in comparison to interactions in regions V and W. The embodiments of the present invention are directed to utilizing the increased fluid movement of the inner regions of the flow zone so that a fine, highly consistent and uniformly mist results.

Parabolic flow in a gas stream causes the outside portion of a gas stream to flow slowly, and the center to flow rapidly. With a properly shaped gas orifice, the liquid can be brought into contact with a faster moving portion of the gas stream and accordingly be imparted with significantly more energy by the gas stream. This causes the liquid to break up into smaller particles than otherwise would be possible. With the addition of a small spout into the gas stream, liquid flows are introduced into the gas stream in the fastest portion of the gas stream, causing even very low flows to be impacted with the highest energy possible, and enabling very low flows to be atomized. With the center portion of a gas stream moving at approximately three times the speed or more of the outer 20% of the gas stream, the energy imparted is the square of the velocity or nine times or more what the liquid would receive if reacting with the outer portion of the gas stream. With the system and method according to the embodiments of the present invention, induction of the liquid into the gas stream may not be as significant in producing atomization as the direct transfer of energy from the gas stream to the liquid.

This can significantly improve the aerosol and increase the range of liquid flow rates over which the nebulizer works. With properly shaped gas and liquid interfaces, the parallel path system and method can be extended to include very large and very tiny liquid flow rates in a single nebulizing device. Very large diameter liquid passages can be used if the liquid flow rate is sufficient to maintain a reasonably constant liquid level near the gas orifice. Also, miniature nebulizers and micro-nebulizers can be made with extrusion methods and microchip techniques. With this system and method according to the embodiments of the present invention, there may not be any limits to size of nebulizers possible, nor any limits to liquid flow rates for atomization.

Conventional parallel path nebulizers for analytical usage have been produced with a simple, round gas passage and orifice. This has provided nebulizers that were difficult to plug, as intended, but the liquid sample flow ranges were generally limited, and usually were required to be 1.5 ml/min to 2 ml/min. Their maximum range was in the 0.5 to 2.5 ml/min range. Below 0.5 ml/min, the nebulizers usually would provide poor or no atomization. When the flow range rises above 2.5 ml/min, the nebulizing devices typically begin to "spit".

It is certified that error appears in the above-identified patent and that said Letters Patent is hereby corrected as shown below:

Column 1, line 1 through Column 13, line 43 (cont'd),

In attempts to produce lower liquid flow rates, smaller liquid capillaries were tried. This was successful, but it was difficult to machine the smaller capillaries. With the usage of multilumen extruded Polytetrafluoroethylene (PTFE) or Teflon® tubing (Teflon is a trademark of DuPont) press fit into larger bodies, very small capillaries became possible for enabling lower liquid flow rates. This design also led to providing for the capability of working with the gas orifice shape, and led to the development of shapes that enhanced the quality of the mist and expanded the range of flow rates. This improved shaping of the gas orifice and liquid interface was then successfully applied to larger nebulizers, for enabling simple, large liquid flow rate, and non-plugging nebulizers to be produced.

The parallel path method as described in U.S. Patent No. 5,411,208 to Burgener lists the gas orifice as being able to be just inside the liquid passage, on the edge or just outside the liquid passage. In practice, the location of the gas orifice has little effect on the quality of the mist as long as the gas orifice is close enough to the liquid passage to contact the liquid and begin interacting with the liquid. The actual distances from the liquid passage depend on the material used. The parallel path method enables devices to be made with non-wetting materials such as Teflon® (Teflon is a trademark of DuPont), but they also work well with wetting materials such as glass, metals and plastics. If the material is non-wetting, the gas orifice needs to be closer to the liquid passage than if the material is wetable. With a wetable material, the liquid spreads out from the liquid passage in all directions for a while before forming drops, and if the gas orifice is within this range, the liquid will make contact with the gas stream, and be drawn into the gas stream, and will form a path to the gas stream maintaining contact and flow from the liquid passage to the gas stream.

From observations of the liquid and gas interaction under a microscope, it is apparent that the liquid interacts with the outside edges of the gas stream and the portion with which it first comes into contact. Depending on liquid flow rates, gas flow rates and types of liquid, the liquid can in some instances be seen to flow up the gas stream for a short distance before beginning to break up into small droplets. The distance is tiny, on the order of the diameter of the gas orifice. However, it clearly indicates that the gas and liquid interaction is essentially occurring on the outer portion of the gas stream.

When the liquid droplets have begun to spread into the rest of the gas stream, the gas stream has already begun to spread and slow. Typically a gas stream will spread out at a 15 degree angle to about double the diameter of the gas orifice after moving 3.75 diameters away from the gas orifice. At double the diameter, the cross section of the gas stream is 4 times the area of the gas orifice, and the gas It is certified that error appears in the above-identified patent and that said Letters Patent is hereby corrected as shown below:

Column 1, line 1 through Column 13, line 43 (cont'd), stream velocities are approaching 1/4 of the speed at the orifice. As the liquid interacts with the outside of the gas stream and rises up in the gas stream for a distance before interacting with the central portions of the gas stream, the energy of the gas stream imparted to the liquid is minimal. If the liquid can be enabled to interact with the center of the gas stream where the energy levels of the gas stream are much higher, the liquid will be broken into much smaller droplets or into a higher proportion of smaller droplets than otherwise possible. There are many ways to direct the liquid into the gas stream. One of the simplest methods of achieving this is to squeeze or distort the gas orifice to produce a lip or spout on the wall between the gas orifice and the liquid.

The gas passage can be of any cross section, and does not need to be circular. The effect of drag along the inner walls of a gas passage is similar regardless of the shape of the cross section of the passage. For simplification of the process described here, circular cross sections will often be used in the discussions that follow. However, any shape of gas passage cross section may be used. The criteria of importance for the passage cross section are: that the gas flow be laminar (non-turbulent); and that the gas passage be straight, tapered, or expanding smoothly so that the gas flow remains laminar.

A tapered gas passage will achieve some of the effect, as the slower portion of the gas flow will be somewhat blocked by the tapered portion of the gas passage, allowing the faster moving portion to continue with minimal blocking, so that the gas exiting at the orifice is moving faster than what would occur in a straight passage. However, the benefit of tapering is small compared to the benefits of a passage with a shaped orifice. The drag due to the taper is extensive, and the gas exiting still follows Poiseuille's Laws with a slow portion at the outside of the gas flow and a faster portion at the center. The drag due to a properly shaped orifice and spout is very tiny and causes little loss of energy to the gas flow. Shaping an orifice to deliver the liquid to the fastest portion of the gas flow works well for any shape passage (expanded, tapered, curving, irregular or straight) as long as the passage has higher velocity gas in the center.

From Poiseuille's Law of fluid flow in capillaries (for non-turbulent fluid flows), gas flow follows a parabolic velocity distribution across the capillary. The gas flow at the edges of a capillary is moving very slowly, essentially at zero velocity. The gas flow in the center moves at twice the average flow rates. The formula is $V(r) = P\ (a^2 - r^2)/4Ln$, where $V(r)$ is the velocity at radius $r$, $P$ is the pressure, $a$ is the radius of the capillary, $L$ is the length of the capillary and $n$ is the viscosity. The velocity distribution goes from 0 at the edges to twice the average velocity at the center. The first 20% of the distance from the edge to the It is certified that error appears in the above-identified patent and that said Letters Patent is hereby corrected as shown below:

Column 1, line 1 through Column 13, line 43 (cont'd), center has velocities less than 1/3 the velocity of the gas at the center. With a parabolic distribution, the velocity is near maximum for a large region near the center. Energy is related to the square of the velocity ($E=1/2\ mv^2$). For instance, an increase of three times the velocity results in an increase of nine times the energy. Accordingly, it is of very significant advantage to be able to have the liquid interact with the central portion of a gas stream rather than with the outside edge.

Note that Poiseuille's Law applies for capillaries much larger in cross section than the mean free path of the fluid molecules. As the cross sections of the capillaries decrease, the flow at the edges increases in velocity and the flow at the center decreases relative to the average flow rates. For capillary cross sections less than 100 times the mean free path of the molecules, the flow patterns are more accurately described by A. Beskok and G. E. Karniadakis, *Models and Scaling Laws for Rarefied Internal Gas Flows Including Separation*, presented at the 48th Annual Meeting of the American Physical Society Division of Fluid dynamics, Irvine, CA, 19-21 Nov. 1995. This flow model shows the effects of very small capillaries and rarefied gases on velocity distributions. As the mean free path becomes larger compared to the diameter of the capillary cross section, the gas at the edges begins to move faster and the gas in the center moves slower relative to the average velocity, and eventually approaches a constant velocity across the capillary. With gases running in the 50 - 100 nanometer ($10^{-9}$ m) range for their mean free path at atmospheric pressure and room temperatures, capillary cross sections would have to be in the order of $10^{-7}$ m ($10^{-5}$ cm or $4X10^{-6}$ inches) in diameter before the advantages of this parallel path enhancement significantly decreases. The parallel path system still works with such very tiny capillaries, but the present enhanced parallel path system does not realize significant advantageous enhancements for such very tiny capillaries as with larger capillaries.

With a gas orifice the same shape as the gas passage, the liquid interacts with the outside of the gas stream, and receives minimal energy from the gas stream. With the gas orifice shaped properly, the liquid can be directed past the slower moving outside of the gas stream into the faster moving central portion of the gas stream. Any change in shape will cause turbulence in the gas stream, and decreases the gas velocities. However, with a minimal, smooth interface between the gas passage and the orifice, the turbulence will be minimal and advantageous enhancements will be achieved.

The shape of the gas orifice on a circular passage can be as simple as a half moon shape and a crescent shape, or more complex such as a "teapot's spout" shape. With the main advantages gained by introducing the liquid at just 20% of the radius of the capillary cross section into the gas stream, the shape change at the orifice can be small and still have a large advantage. For instance, for a It is certified that error appears in the above-identified patent and that said Letters Patent is hereby corrected as shown below:

Column 1, line 1 through Column 13, line 43 (cont'd), capillary cross section that is 10 thousandths of an inch in diameter, 20% of the radius is 1 thousandth of an inch. An indentation of 4 to 6 thousandths would carry the liquid to the fastest portion of the gas stream, but even an indentation in the orifice of 1 thousandth of an inch is sufficient to significantly increase the energy imparted to the liquid.

Figs. 5A-5F illustrate embodiments of the present invention which distort a circular gas orifice for a circular gas passage in achieving the improved dispersion of liquids into a gaseous medium over a large range of liquid flow rates. In Fig. 5A, a cross-section of the fluid flow zones for a circular orifice is shown. Minor distortion $R_1$ of the orifice sufficiently bypasses the two slowest moving fluid flow regions V and W. Accordingly, the fluid is directed to flow into the faster moving regions X, Y and Z, which improves the dispersion of the fluid. In Fig. 5B, an orifice is provided with a greater distortion $R_2$ of the orifice for sufficiently bypassing the three slowest regions of the fluid flow, regions V, W, and X. Here, the fluid flow is improved even more than realized by the orifice of Fig. 5A because the fluid flows only in the two fastest moving regions Y and Z. In Fig. 5C, the fluid flow is improved even more by increasing the distortion $R_3$ to bypass regions V, W, X, and Y so that the fluid flows only in the fastest moving area, region Z.

The designs of orifices shown in Figs. 5D, 5E, and 5F are all effective in improving the gas and liquid interaction by bringing the liquid to the faster portions of the fluid flow in the flow zone. The crescent shaped distortions of the circular shaped orifices in Figs. 5E and 5F still deliver the liquid to a gas flow area near the average speeds so it is still effective in improving the gas and liquid interaction. In practice, the orifices of Figs. 5C, 5D, and 5E are the most effective and are easiest to produce.

Figs. 6A-6D illustrate spouts and distortions of circular gas orifices according to embodiments of the present invention. In Fig. 6A, minor distortion $R_1$ of an orifice is sufficient to bypass the two slowest moving regions V, and W so that the gas flows in the faster regions X, Y and Z. A spout $S_1$ is also provided that reaches into the fastest moving portion of the gas flow, region Z, for improving the dispersion of liquids in a gaseous medium. Greater distortion $R_2$ of an orifice is shown in Fig. 6B for bypassing the three slowest moving regions V, W, and X so that the gas flows in the two fastest regions Y and Z. A spout $S_2$ is also provided so that the gas can reach into the fastest moving portion, region Z, of the gas stream. Similarly, orifices of Figs. 6C and 6D have greater distortion $R_3$ and $R_4$ and spouts $S_3$ and $S_4$, respectively, for bringing the liquid to the fastest regions of the flow zone.

It is certified that error appears in the above-identified patent and that said Letters Patent is hereby corrected as shown below:

Column 1, line 1 through Column 13, line 43 (cont'd),

Fig. 7 illustrates another embodiment of the present invention for an elliptical gas orifice. Distortion $R_1$ and spout $S_1$ are provided for this elliptical gas orifice for bringing the liquid to the faster regions of the flow zone.

Fig. 8 illustrates a rectangular gas orifice according to another embodiment of the present invention. Similar to the elliptical orifice, distortion $R_1$ and spout $S_1$ are provided for bringing the liquid to the faster regions of the flow zone. In each of the circular, elliptical and rectangular orifice variations, the liquid flow is delivered to the faster regions of the gas flow to achieve about the same improvement for the liquid dispersion. However, for high flows, the circular gas orifice with the distortion $R_4$ shown in Fig. 6D provides the best overall performance across high and low flows in a single nebulizing device.

Figs. 9A, 9B, and 9C illustrate gas orifices having spikes similar in shape to spikes on the heads of some trilobites according to further embodiments of the present invention. The "trilobite spikes" cause some portions of the gas to flow away from the gas orifice and create a barrier to the liquid flow. As a result, the build up of droplets on the edge of the orifice is reduced which prevents spitting of such droplets. In Fig. 9A, an orifice having trilobite spikes $T_1$ includes distortion $R_1$ and spout $S_1$ in a similar design to the circular orifice of Fig. 6D. The respective orifices having trilobite spikes $T_2$ and $T_3$ of Figs. 9B and 9C further squeeze the orifices by providing distortion $R_2$ and $R_3$, and spouts $S_2$ and $S_3$. Each of these embodiments produces similar atomization results. In practice, the orifices of Figs. 9A, 9B, and 9C are minor modifications of the orifice shapes shown in Figs. 6A-6D. They are easily produced by simply adding the spikes to the orifice shapes of Figs. 6A-6D. Similar spikes should be as effective for shaped orifices on non-circular passages.

Figs. 10A, 10B, 10C, and 10D illustrate designs of the gas orifice and liquid exit areas according to embodiments of the present invention. In Figs. 10A-10D, gas orifices are provided in a similar shape as described in Fig. 9A with liquid passages tied into spouts of the gas orifices. In the embodiment illustrated in Fig. 10A, a liquid exit area $C_1$ is provided that is much smaller than the gas orifice $F_1$. The liquid exit area $C_1$ is tied into a spout $S_1$ of the gas orifice $F_1$. Fig. 10B illustrates a liquid exit area $C_2$ that is similar in size to a gas orifice $F_2$. The liquid exit area $C_2$ is tied into a spout $S_2$ of the gas orifice $F_2$. In the embodiment illustrated in Fig. 10C, a liquid exit area $C_3$ is provided that is slightly larger than a gas orifice $F_3$. The liquid exit area $C_3$ is tied into a It is certified that error appears in the above-identified patent and that said Letters Patent is hereby corrected as shown below:

Column 1, line 1 through Column 13, line 43 (cont'd), spout $S_3$ of the gas orifice $F_3$. In the embodiment illustrated in Fig. 10D, a liquid exit area $C_4$ is provided that is very much larger than a gas orifice $F_4$. The liquid exit area $C_4$ is tied into a spout $S_4$ of the gas orifice $F_4$. Figs. 10A-10D show that the surface tension of the liquid, the wetability of the device material, the flow rate of the liquid and the rate and pressure of the gas flow are much less important factors in this design than in the conventional parallel path method. However, orientation may be important if the liquid passage and exit area are larger than the free drop size of the liquid. The configuration of the gas and liquid interface determines the ability of the system to produce the desired atomization. The size and shape of the liquid passage and exit area for the liquid body is not important. The gas and liquid interaction only depends on the gas and liquid interface shape, the gas flow rates, the liquid flow rates, and the ability of the liquid to provide a steady flow to the gas orifice and gas stream.

Fig. 11 illustrates a detailed cross section showing the gas and liquid interaction of a nebulizing device according to an embodiment of the present invention. The device includes a body $M_1$, a gas orifice $F_1$ and a liquid exit area $C_1$. The liquid enters the liquid passage at $A_1$, passes through the liquid passage $B_1$ and the gas enters the gas passage at $D_1$, and passes through gas passage $E_1$. An interface $R_1$ includes a gas orifice of a circular shape having a minimal distortion, similar to the distortion described in Fig. 5C.

The gas orifice $F_1$ is slightly widened to move the slow gas flow a bit farther away from the central faster flow, which decreases any turbulence due to the distortion of the interface area $R_1$. Induction effects are indicated by arrows $J_1$ and the resultant atomized liquid $K_1$ is also shown.

Fig. 12 illustrates a detailed cross section showing the gas and liquid interaction of a nebulizing device according to an embodiment of the present invention with a spout interface. The device is configured similar to Fig. 11 and like references are used for similar elements. In contrast to Fig. 11, a spout $S_2$ is provided at an interface $R_2$. The system of Fig. 12 is more difficult to manufacture as compared to the system of Fig. 11 but a larger range of liquid flow rates with effective atomization can be achieved by the system of Fig. 12.

Typically, with these enhancements, the shape of the gas orifice for a circular cross sectional passage ranges from slightly off circular, to flattened, to slightly concave towards the liquid, to a crescent shape orifice concave to the liquid. While it is apparent that many other shapes will produce similar results in enabling the liquid to interact with the higher velocity portion of the gas flow, the variations from near circular to crescent are the easiest to produce with the present mechanisms. For rectangular shaped gas passages, the orifice can be most easily modified by distorting one It is certified that error appears in the above-identified patent and that said Letters Patent is hereby corrected as shown below:

Column 1, line 1 through Column 13, line 43 (cont'd), of the longest sides of the orifice. For irregular shape passages, one seeks the easiest portion to modify that will give the liquid access to the fastest moving portion of the gas stream.

With this method, the advantages of a shaped gas orifice are significant for small, medium and large changes. The presence of spouts or other shapes to deliver the liquid into the faster portion of the gas stream adds many more possible variations. The distortions to the gas orifice do not need to be precise or exact to achieve the effect, which allows a large selection of manufacturing means to accomplish the effect. It is generally very easy to modify the gas orifice in such a way as to improve the gas flow interaction with the liquid.

One caution in the production of the present nebulizing systems is that the modifications to the gas orifice should be minimal and smooth, so that there is minimal turbulence caused by the interface which would decrease the gas flow velocities past the interface. The presence of any material will necessarily create a drag on the gas flow, and will create some turbulence. A turbulence zone and slow gas flow due to drag from the spout will typically be very small and of no significant effect, but can be very large if the spout and interface are too large or not smooth.

It is apparent that any device that directs the liquid to the faster moving portion of the gas stream, or directs the faster moving portion of the gas stream to the liquid will achieve a similar effect. For instance, placing an object just outside of the gas orifice to re-direct the gas flow may have a similar effect to changing the shape of the gas orifice.

Fig. 13 illustrates a gas and liquid interface that provides a spout between the liquid and the gas stream's higher velocity interior region, but without the spout being formed by modifying the wall between the gas stream and the liquid. The device is configured similar to Fig. 11 and like references are used for similar elements. In this illustration, the interface $R_3$ is created by a separate object $U_3$ that is not attached to the gas stream's orifice, nor the gas stream's wall nor to the liquid passage's wall.

However, changing the shape of the gas orifice is more efficient and easier to manufacture than baffles or other objects to redirect the gas flow or liquid flow. Also, changes in gas flow after the gas has exited the orifice will be less effective as the gas will begin to spread and decrease in velocity immediately. Bringing the liquid into contact with the gas stream before there is any expansion and loss of velocity is the most effective way to impart the energy from the gas stream to the liquid.

It is certified that error appears in the above-identified patent and that said Letters Patent is hereby corrected as shown below:

Column 1, line 1 through Column 13, line 43 (cont'd),

Where it is possible to produce a spout into a mid-portion of a gas stream (not at an orifice), it will be possible to produce atomization of the liquid within the gas stream. Although not the standard practice for nebulizers, it is beneficial for some applications such as for mixing a liquid into a chemical process line. In these discussions, references to orifices should be recognized to include such spouts in mid stream, with the tip of the spout being effectively the determining point for deciding where the "orifice" is. Effectively the spout is the nebulizer and the section of the gas stream where the spout is, behaves like an orifice.

Fig. 14 illustrates a detailed cross section near the gas and liquid interaction of a nebulizing device according to an embodiment of the present invention with a spout interface in a mid-portion of a gas stream. The device is configured similar to Fig. 12 and like references are used for similar elements. As in Fig. 12, a spout $S_4$ is provided at an interface $R_4$. In this embodiment, the spout extends into a gas stream in a mid section of the gas stream and not at an orifice. The locations of the liquid exit and gas exit are not important in this configuration.

Adding a "teapot spout" shape to the gas orifice helps lower flows arrive at the central portions of the gas stream without being caught up in the slower portions of the gas stream. The spout of the interface works best as a smoothly curving surface, extending from a wide part inside the liquid passage to a smaller part extending into the gas passage. For very low flows, a spout shaped similar to the teapot spout helps draw the liquid into the higher velocity portion of the gas stream. As with the teapot spout, the low flow spout should smoothly curve over its length and point down into the gas passage, and should be smallest at the tip extending into the gas passage. The size of the spout relates to the flow rates desired. A large spout is better for higher flow rates, a smaller spout for low flow rates. For large ranges of flow rates, a large spout with a tapered centerline can effectively produce both a large interface and a small interface. The radius of curvature of the spout does not seem to be critical as long as it is a smooth transition from the liquid passage into the gas passage.

According to embodiments of the present invention, very tiny nebulizers can be made with the parallel path method and system. For instance, microcircuit production techniques can be used to create two passages on a silicon wafer that meet at some point, with a minor non-linear interface. This will provide enough of a spout to allow the enhanced method to be of advantage as long as the passages are 100 or more times the mean free path. At atmospheric pressure for air, Nitrogen, and Argon, the mean free paths are in the order of 10 to 100 nanometers, so a passage of 1000 nanometers wide still has parabolic flow (1000 nanometers is 1 X 10-6 meter, 1/millionth of a meter). These nebulizers can be produced for even smaller passages, but the advantages of the orifice being modified from the gas passage cross section decrease as the passage width approaches the mean free path.

It is certified that error appears in the above-identified patent and that said Letters Patent is hereby corrected as shown below:

Column 1, line 1 through Column 13, line 43 (cont'd),

Figs. 15, 16, 17 and 18 illustrate some examples of nebulizing devices that may be utilized in the embodiments of the present invention. In Fig. 15, an enhanced parallel path nebulizer is shown that is able to atomize from 1 ml/min to 100 ml/min of liquid. The nebulizer includes a body $M_5$ having a gas orifice $F_5$ and a liquid exit area $C_5$. Gas is supplied to the gas orifice $F_5$ by connecting an external gas supply line $O_5$ to a connector $N_5$, such as a fitting screwed into the body $M_5$, for passing the gas through a passage $E_5$. Similarly, liquid is supplied to the liquid exit area $C_5$ by connecting an external liquid supply line $Q_5$ to an internal tube $B_5$. The external liquid supply line $Q_5$ may be press fitted into the body $M_5$ or attached with fittings. The large passage for the liquid creates some potential effects due to orientation but for higher flow rates, the orientation is not critical.

Fig. 16 illustrates an enhanced parallel path nebulizer according to another embodiment of the present invention that is able to atomize from flow rates of 1 microliter/min to 3,000 microliter/min. The nebulizer includes a body $M_6$ having a gas orifice $F_6$ and a liquid exit area $C_6$. To produce long and tiny capillaries, a multilumen extruded tube $L_6$ with two capillary holes, $B_6$ and $E_6$, running through the length of the tube is notched at notch $G_6$ and plugged at the back of the liquid passage $H_6$ and pulled into the body $M_6$. As a result, a liquid and gas tight press fit seal is produced between the multilumen tubing $L_6$ and the body $M_6$. Gas enters the device through a gas line $O_6$ to a gas connector $N_6$ and passes through the notch $G_6$ into the unplugged passage in the multilumen tubing $L_6$. The gas exits the device at the gas orifice $F_6$. The liquid travels the length of the body $M_6$ from the liquid supply line $Q_6$ along the capillary $B_6$ to the liquid passage exit area $C_6$. The liquid supply line $A_6$ is attached with connector $P_6$.

Fig. 17 illustrates yet another embodiment for an enhanced parallel path nebulizer according to the present invention, which utilizes integrated circuit technology. In this embodiment, the nebulizer is etched onto a circuit board $M_7$. The etching provides a liquid passage $B_7$ for liquid supplied at pad $A_7$ and exiting at liquid exit area $C_7$. Similarly, a gas passage $E_7$ for gas supplied at pad $D_7$ and exiting at gas orifice $F_7$ is provided.

Fig. 18 illustrates an enhanced parallel path nebulizer according to another embodiment of the present invention that is designed to atomize liquid from a surrounding body of liquid rather than utilizing a liquid constrained in a passage in a nebulizer body. The liquid surrounds the gas orifice. Such devices have very large flow ranges, from microliters to liters per minute depending on the size of the gas orifice and the pressure and rate of flow of the gas. The liquid surface moves into the interface $R_8$ and along the spout $S_8$ due to gravity, induction, surface tension effects, currents in the liquid or other forces. This embodiment includes a body $M_8$ which is a tube, having a gas orifice $F_8$ and a liquid surface acting as the "exit area" $C_9$. Gas is supplied by a compressor or pressurized gas source It is certified that error appears in the above-identified patent and that said Letters Patent is hereby corrected as shown below:

Column 1, line 1 through Column 13, line 43 (cont'd), 18-1. The gas exits the device at the gas orifice $F_8$ , atomizing the liquid as a fine mist $K_8$. Maintaining the correct spacing between the liquid surface and the gas orifice is often difficult in such a configuration. If the liquid comes in too fast, it does not break into small droplets.

Fig. 19 illustrates the device shown in figure 16, with body M9, with attached liquid and gas delivery systems. The liquid may be supplied by a pump or gravity feed system 19-2, the gas may be supplied by a compressor or pressurized source 19-1. The liquid is conveyed to the device in a liquid line $Q_9$, and the gas conveyed to the device in a gas line $O_9$. The liquid line is attached to the device with an appropriate fitting $P_9$, and the gas line is attached with an appropriate gas fitting $N_9$. The style of the liquid supply and gas supply do not effect the device's operation as long as they are able to supply enough liquid and gas. For analytical purposes, both the gas and the liquid must be delivered with high consistency to ensure stable results in the analytical instrument.

It is appreciated that the present invention is not limited to only these above-described devices, and that these devices are provided as only some examples of nebulizing devices that may be used in conjunction with the present invention.

The results of the system and method according to the embodiments of the present invention have been significant for analytical nebulizers using the parallel path method. Previous designs of nebulizers produced fairly standard results compared to other nebulizer methods. Embodiments of the parallel path method according to the present invention have produced much larger portions of the mist in small droplets as compared to other known nebulizers. Comparisons of high pressure concentric nebulizers have shown that a modified parallel path method nebulizer running at 40 psi (2.7 bar, 270 kPa) produces a mist most comparable to a concentric nebulizer running at 160 psi (11 bar, 1100kPa), and far superior in distribution of small droplet sizes to concentric nebulizers running at 40 psi. As most analytical instruments have a limit of a maximum of 45 to 50 psi pressure, being able to match the performance of a 160 psi device with a 40 psi device is unique, and very desirable.

The enhanced parallel path nebulizers according to the embodiments of the present invention have a very large range of liquid flow rates possible and some capable of producing good atomization over the range of 1 microliter per minute up to 3000 microliters per minute have been achieved, which is a range of 3000 times. The previous best range possible was only five times (from 0.5 to 2.5 ml/min). The liquid flow rate is independent of the atomization process. The present systems and methods do not produce any suction on the liquid, so the liquid must be delivered to the gas orifice through means such as gravity feed or pumping of the liquid.

It is certified that error appears in the above-identified patent and that said Letters Patent is hereby corrected as shown below:

Column 1, line 1 through Column 13, line 43 (cont'd),

The operating range of the liquid flow for such analytical nebulizers is determined by the shape of the gas orifice, the gas flow rates and the surface tension of the liquid. Generally, liquids with lower surface tension will produce finer droplets.

The standard parallel path methods and systems enable nebulizers to be constructed with the gas orifice much smaller than the sample passage. In contrast, most nebulizers require a gas orifice of a similar size or larger size than the liquid passage. With the systems and methods according to the embodiments of the present invention, the gas orifice can be any size relative to the liquid passage, as the only significant portion of the liquid and gas interaction is occurring at the tip of the interface or spout in the gas orifice. As long as the liquid arrives to the tip in a steady flow, the nebulizer will produce a consistent atomization. So excellent atomization is possible with a very tiny liquid passage or a liquid passage having the same size as the gas orifice, or a very large liquid passage. The criteria is more dependent on flow rates than physical configuration of the body of the devices or the size of the liquid passages and the flow rates allowable for any device can work over very large ranges as previously described.

Most pneumatic nebulizers rely on induction to mix the liquid into the gas and achieve atomization. Induction occurs due to suction of lower pressure zones near the gas caused by the flow of the gas stream. This creates a gas flow or "wind" across the liquid, which draws the liquid into the gas stream, enabling the gas to impart its energy into the liquid, causing the liquid to break up into droplets. Induction occurs around any gas stream. Induction is important in the parallel path method. However, in the present system and method, induction does not seem to be the only factor occurring, and may not be the main factor. As liquids flow into the liquid passage, the liquid passage exit area is filled due to surface tension effects. The liquid will fill the passage whether or not the gas stream is flowing. As the liquid fills the passage, the interface between the liquid passage and the gas passage is also filled. With a spout extending into the gas passage, the liquid will flow along the spout and into the gas stream area. The liquid wets the spout or if the material is non-wetting, then the liquid fills the spout and begins to bead up. If the gas stream is turned on, the liquid on the spout will be impacted by the gas stream, and tossed into the direction of the gas stream's flow and break up into droplets.

As the liquid is tossed away by the gas stream, more liquid will flow onto the spout to fill the vacated area. The liquid will flow into the interface between the gas and the liquid both because it is inclined to do so due to surface tension spreading the liquid onto the spout as it would when there is no gas flow, and also due to the surface molecules being more tightly bound to each other than the non-surface molecules, so that as the surface molecules are impacted with the gas stream they move away from the liquid and pull the

UNITED STATES PATENT AND TRADEMARK OFFICE

CERTIFICATE OF CORRECTION

PATENT NO. : 6,634,572 B1
DATED : October 21, 2003
INVENTOR(S) : John A. Burgener It is certified that error appears in the above-identified patent and that said Letters Patent is hereby corrected as shown below:

Column 1, line 1 through Column 13, line 43 (cont'd), attached surface molecules after them into the gas stream. As the surface of the liquid is pulled towards the gas stream by the outgoing molecules, the liquid forms a "bridge" to the gas stream along which the surface of the liquid flows to the gas stream. Consider a swimming pool in which the skimmer selectively allows the surface of the pool's water to flow into the filter, bringing all of the floating leaves and debris with it. The interface is acting much like a pool skimmer and causes the gas stream to pull the surface molecules into it, and then toss them away. As such, there is a direct interaction between the gas stream and the liquid, and induction may have little or no influence on the interaction.

It will be apparent to those skilled in the art that other modifications to and variations of the above-described techniques are possible without departing from the inventive concepts disclosed herein. Accordingly, the invention should be viewed as limited solely by the scope and spirit of the appended claims. --

Signed and Sealed this

Tenth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,634,572 B1
DATED : October 21, 2003
INVENTOR(S) : John A. Burgener It is certified that error appears in the above-identified patent and that said Letters Patent is hereby corrected as shown below:

Column 15,
Line 18, “orifice said” should read -- orifice, said --; and

Column 16,
Line 23, “polytetraflouro” should read -- polytetraflouroethylene --.

Signed and Sealed this

Twenty-fifth Day of October, 2005

JON W. DUDAS
*Director of the United States Patent and Trademark Office*